US012735881B2

(12) United States Patent
Lipinski

(10) Patent No.: US 12,735,881 B2
(45) Date of Patent: Sep. 15, 2026

(54) TOILET FLUSH CONTROLLER

(71) Applicant: Kohler Co., Kohler, WI (US)

(72) Inventor: John O. Lipinski, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 124 days.

(21) Appl. No.: 18/606,653

(22) Filed: Mar. 15, 2024

(65) Prior Publication Data

US 2024/0328134 A1 Oct. 3, 2024

Related U.S. Application Data

(60) Provisional application No. 63/454,819, filed on Mar. 27, 2023.

(51) Int. Cl.
*E03D 5/10* (2006.01)

(52) U.S. Cl.
CPC ..... *E03D 5/105* (2013.01)

(58) Field of Classification Search
CPC ..... E03D 5/105
See application file for complete search history.

(56) References Cited

U.S. PATENT DOCUMENTS 2,813,274 A 11/1957 Lewis et al.
5,909,041 A * 6/1999 Hosier ..... H10F 39/803 257/292
6,535,134 B2 * 3/2003 Lang ..... E03D 13/00 340/622
7,127,749 B2 10/2006 Ling
7,156,363 B2 1/2007 Parsons
8,407,821 B2 4/2013 Chan
10,253,486 B2 * 4/2019 Plas ..... E03D 1/14
2016/0083949 A1 3/2016 Plas
2017/0233992 A1 8/2017 Oberholzer
2018/0010322 A1 1/2018 Grover et al.
2018/0038089 A1 2/2018 Caldwell

FOREIGN PATENT DOCUMENTS

EP 1378612 A1 1/2004
EP 1378612 B1 3/2006
WO 2016073651 A1 5/2016
WO WO-2022192942 A1 * 9/2022 ..... E03D 1/00

OTHER PUBLICATIONS

Extended European Search Report from European Patent Application No. 24165269.2, dated Dec. 18, 2024, 10 pages.

* cited by examiner

*Primary Examiner* — Janie M Loeppke
(74) *Attorney, Agent, or Firm* — Lempia Summerfield Katz LLC

(57) ABSTRACT

Provided is a toilet including a bowl having a sump, a trapway in fluid communication with the sump, a first photogate coupled to the sump and configured to detect a presence of waste in the sump, and a second photogate coupled to the trapway and configured to detect a presence of waste in the trapway.

10 Claims, 15 Drawing Sheets

TOILET FLUSH CONTROLLER

This application claims priority benefit of Provisional Application No. 63/454,819 filed Mar. 27, 2023, which is hereby incorporated by reference in its entirety.

FIELD

The present application relates generally to the field of toilets. More specifically, the present disclosure relates to toilets configured to sense the contents of a toilet bowl and initiate an operational cycle in response to the sensed contents.

BACKGROUND

In consideration of environmental and economic concerns, more efficient toilets that use less water are being designed and manufactured. One method of decreasing water consumption is to decrease the amount of water that is released during each operational or flush cycle of the toilet. However, decreasing the amount of water released during a flush cycle reduces the flushing power of the flush cycle, reducing the ability of the flush cycle to remove waste from the toilet.

BRIEF DESCRIPTION OF THE DRAWINGS

Objects, features, and advantages of the present disclosure should become more apparent upon reading the following detailed description in conjunction with the drawing figures, in which:

FIG. 1 illustrates a toilet including a tank and FIG. 2 illustrates a tankless toilet according to exemplary embodiments of the present disclosure.

The figures illustrate certain exemplary embodiments of the present disclosure in detail. It should be understood that the present disclosure is not limited to the details and methodology set forth in the detailed description or illustrated in the figures. It should be understood that the terminology used herein is for the purposes of description only and should not be regarded as limiting.

DETAILED DESCRIPTION

Described herein are apparatuses, systems, and methods for sensing the contents of a toilet bowl and initiating an operational or flush cycle in response to the sensed contents of the bowl. The various apparatuses, systems, and methods described herein may be configured to initiate different flush cycles which release different volumes of water based on the sensed contents of the bowl. Accordingly, the apparatuses, systems, and methods described herein may determine a quantity of water needed to evacuate the bowl of the toilet using the sensed contents and select a flush cycle that releases the least amount of water and is capable of evacuating the bowl. In accordance with some examples of the present disclosure, a quantity of water provided through each of the rim outlet and a sump jet outlet may be determined based on the sensed contents of the bowl.

The apparatuses, systems, and methods described herein may include various different sensors for sensing the contents of the bowl. For example, a photogate including an emitter configured to emit a light and a detector configured to detect the emitted light may be used to sense the contents of the bowl. In other examples, a camera may be used to detect the contents of the bowl. In yet other examples, a transmitter configured to emit an ultrasonic wave and a receiver configured to sense the ultrasonic wave may be used to sense the contents of the bowl. In some examples, one or more capacitive sensors may be used to sense the contents of the bowl.

In some examples, apparatuses, systems, and methods described herein may selectively control a volume of water released during each operational or flush cycle of the toilet based on the sensed contents of the bowl. Accordingly, the use of excess water, not required to evacuate the contents of the bowl and/or rinse (e.g., clean) the bowl during a flush cycle may be prevented. In some examples, the apparatuses, systems, and methods described herein may initiate different flush cycles using or releasing different volumes of water depending on the sensed contents of the bowl. Accordingly, water consumption may be reduced.

Figure 1:
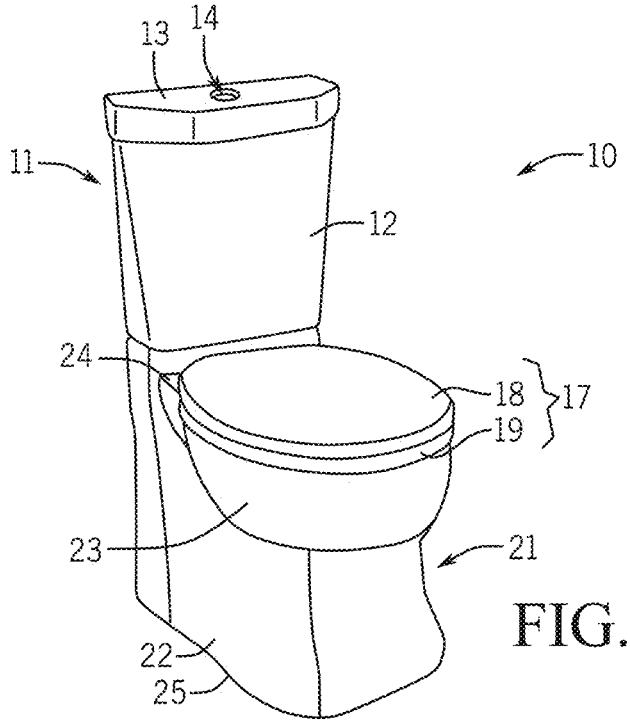
FIGS. 1 and 2 illustrate perspective views of exemplary embodiments of toilets according to the present disclosure. Specifically.
Figure 2:
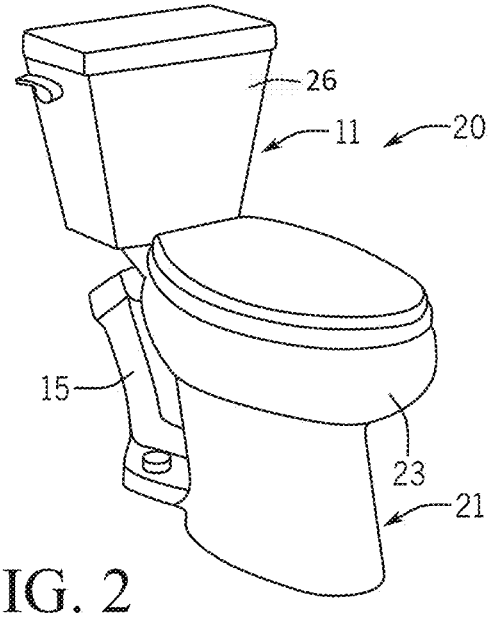

FIGS. 1 and 2 illustrate toilets according to exemplary embodiments of the present disclosure. FIG. 1 illustrates an exemplary embodiment of a skirted toilet 10 that includes a tank 11, a pedestal 21 (or base), a seat assembly 17 and a coupling or mounting assembly. The tank 11 may include a plurality of walls 26 defining a reservoir 12 for storing the water used during operational (or flushing) cycles, a lid (or cover) 13 for providing selective access into the reservoir 12, and an actuator 14 that is configured to initiate an operational cycle when activated. The actuator 14 or flush mechanism may be a button configured to activate when depressed (or pulled) a predetermined distance or when touched, a lever configured to activate when rotated a predetermined angular travel, or any suitable device configured to activate based upon an input manipulation by a user.

It should be noted that the shapes and configurations of the tank, pedestal, seat assembly, and the internal components (including the trapway and other features) may vary from the embodiments shown and described herein, and that the embodiments disclosed herein are not intended as limitations. It should be noted that various components of the toilet may be made of vitreous china. It should be noted that various components of the toilet may be polymeric and/or over molded or otherwise fixed to the toilet. It should be noted, for example, that although the exemplary embodiment of the toilet 10 is shown configured with the tank 11 formed separately from the pedestal 21 and later coupled to the pedestal, the tank may be integrally formed with the pedestal as a one-piece design. In other words, the toilet may be a one-piece design, a two-piece design, or have any suitable configuration. The toilet disclosed herein may have a wide variety of skirted toilet configurations, and all such configurations are intended to be encompassed herein. The following description of various toilet features is therefore intended as illustration only of one possible embodiment, and it should be understood by those reviewing the present description that similar concepts or features may be included in various other embodiments.

The tank 11 may include an inlet opening configured to receive water from a coupled water supply, such as from a hose (e.g., line, tube). The tank 11 may also include an inlet valve assembly or other device configured to control the flow of water from the water supply into the tank through the inlet opening. Within the tank 11 may be provided a float device for controlling the inlet valve assembly, such as by opening the valve to refill the reservoir 12 of the tank 11 after an operational cycle and closing the valve when the water in the reservoir 12 reaches a preset volume or height. The tank 11 may also include an outlet opening configured to transfer (e.g., conduct) the water stored in the reservoir 12 of the tank to the pedestal 21 upon activation of the actuator 14. The pedestal 21 may include toilet bowl 23. The tank 11 may include an outlet valve assembly or other device configured to control the flow of water from the tank into the pedestal 21 through the outlet opening.

The pedestal 21 (or base) of the toilet 10 may include a wall 22 having any suitable shape that is configured to form a bowl 23 having an opening formed by an upper rim at the top of the opening. The pedestal 21 may also be configured to include a plurality of walls having varying shapes that together form a bowl having an opening formed by a rim. The wall 22 of the pedestal may extend downward and/or rearward from the bowl 23 to form a lower portion 25 configured to support the pedestal 21 and the toilet 10. The lower portion 25 may be formed by the end (e.g., lower rim) of the wall 22, or may include a member that extends generally in a horizontal plane from one or more than one end of the wall. The pedestal 21 may also include a top member 24 that extends between two sides of the wall 22 (or between two opposing walls) and is provided rearward (or behind) the bowl 23, wherein the top member 24 forms a plateau for supporting the tank 11, such as the bottom surface of the reservoir 12 of the tank 11. The top member 24 may include an inlet opening that may be aligned with the outlet opening of the tank 11, such as when the tank 11 is coupled to (or resting above) the pedestal 21, wherein water is selectively transferred (e.g., conducted) from the tank 11 through the outlet opening of the tank to the pedestal 21 through the inlet opening of the pedestal 21, when the toilet is activated through the actuator 14. The outlet valve assembly may control the flow of water from the tank to the pedestal. The toilet may also include a gasket or seal that is provided between the tank 11 and the pedestal 21 to prohibit leaking. For example, a gasket may be provided between the outlet opening of the tank and the inlet opening of the pedestal to prohibit leaking between the tank and the pedestal.

The plateau formed by the top member 24 of the pedestal 21 may also provide for coupling of the seat assembly 17 to the pedestal 21 of the toilet 10. For example, the top member 24 may include one or more than one opening, wherein each opening is configured to receive a fastening device (e.g., bolt, screw, etc.) to couple (e.g., attach) the seat assembly 17 to the top member 24 of the pedestal 21. As another example, the top member 24 may include one or more than one fastening device (e.g., bolts, recessed nuts, etc.) integrally formed therein (i.e., already provided connected or coupled to the pedestal 21), wherein the fastening device may be used to couple or secure at least a portion of the seat assembly 17 to the pedestal 21.

The bowl 23 of the pedestal 21 may be configured to include a receptacle (e.g., sump) and an outlet opening, wherein the water and waste is collected in the receptacle until being removed through the outlet opening, such as upon activation of the actuator 14. The pedestal 21 may also include a pedestal internal passageway, such as a trapway, that connects the outlet opening or discharge outlet of the bowl 23 to a drain or soil pipe. The passageway, or trapway, generally includes a first portion, a second portion, and a weir separating the first and second portions. The first portion of the passageway may extend from the outlet opening of the bowl 23 at an upwardly oblique angle to the weir. The second portion of the passageway may extend from the weir downwardly to the exiting device, such as the drain or soil pipe.

Between operational cycles (e.g., flush cycles) of the toilet 10, the water (and waste) is collected in the first portion of the trapway (in addition to the receptacle of the bowl), such that the weir prohibits the water from passing past the weir and into the second portion of the trapway. A flushing cycle may begin upon activation of the actuator 14. Upon activation of the actuator, additional water may be discharged into the bowl 23 of the pedestal 21, resulting in the flushing action and waste removal through the soil pipe. The flushing cycle may include generation of a siphon to assist the flushing action and waste removal.

The seat assembly 17 may include a cover member 18 (e.g., lid), a seat member 19 (e.g., ring member), and a hinge. The seat member 19 may be configured to include an annular member that encircles an opening, wherein the annular member provides a seating surface for the user of the toilet 10. The seat member 19 may also be pivotally coupled (e.g., attached) to the hinge, wherein the seat member may rotate (or pivot) about the hinge, such as between a first lowered or seated position and a second raised or upright position. The cover member 18 may be configured to be round, oval, or any other suitable shape. Typically, the profile or shape of the outer surface of the cover member will be configured to match (i.e., to be substantially similar) to the profile of the outer surface of the seat member to improve the aesthetics of the seat assembly and toilet. The cover member 18 may also be coupled to the hinge, wherein the cover member may rotate (or pivot) about the hinge, such as between a first lowered or down position and a second raised or upright position. The cover member 18 may be provided above the seat member in the down position to thereby cover the opening of the seat member 19, as well as to conceal the inside of the bowl 23 of the pedestal 21. The cover member 18 may be configured to rest against the outside surface of the tank 11, when the cover member 18 is in the upright position, such that the cover member 18 remains in the upright position in order for a user to sit upon the seat member 19.

FIG. 2 illustrates a non-skirted toilet 20 according to another exemplary embodiment of the present disclosure. The internal components, including the trapway 15, are visible in the pedestal 21 of non-skirted toilet 20. It should be noted that the devices, methods, and systems described herein may include and/or be used with both skirted and non-skirted toilets. It should further be noted that devices, methods, and systems described herein may include or be used with both toilets including tanks and tankless toilets. A waterline may supply a tankless toilet with water during a flush cycle.

Figure 3:
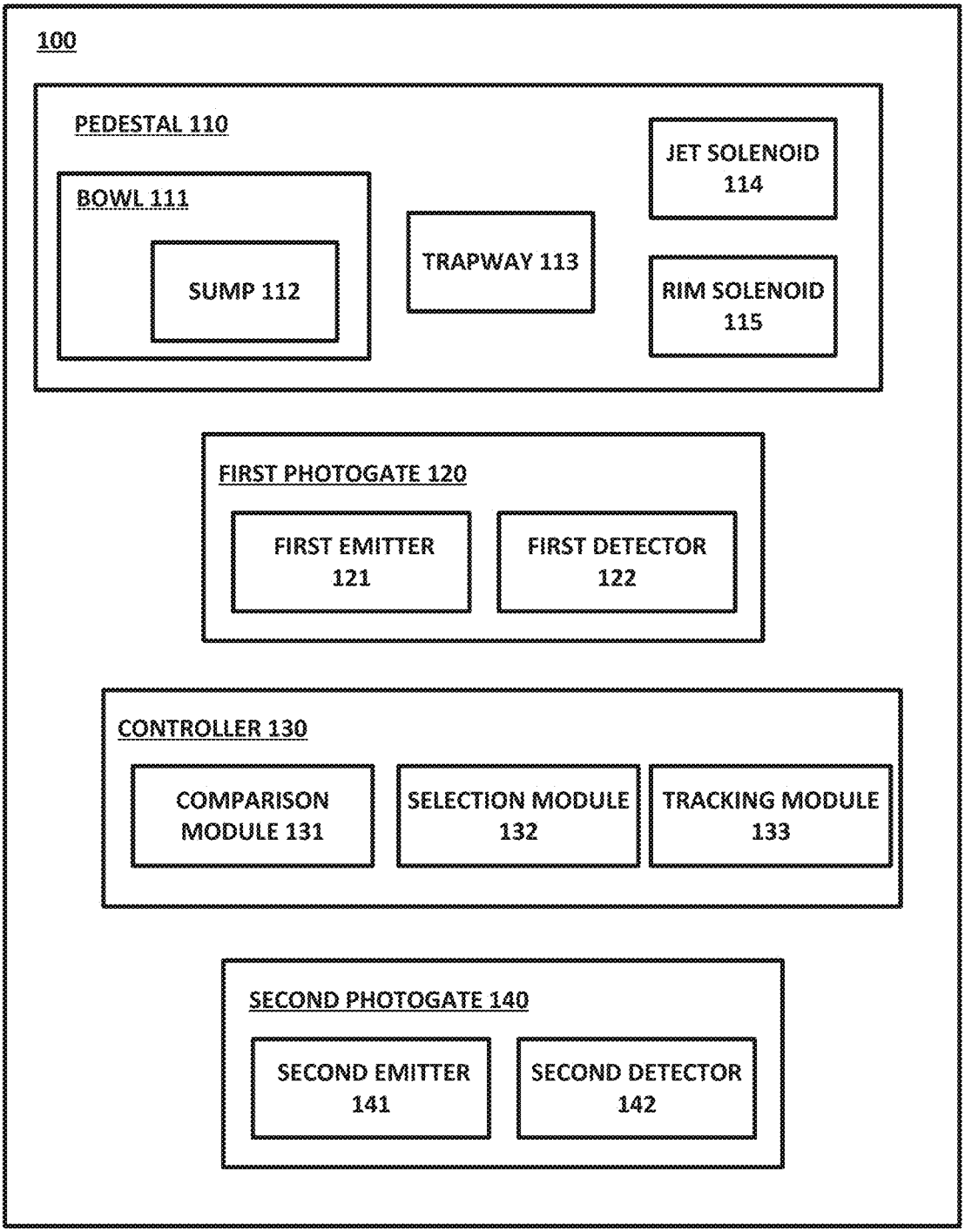
FIG. 3 illustrates a system for sensing the contents of a sump according to an exemplary embodiment of the present disclosure.

FIG. 3 illustrates a system 100 for sensing the contents of a toilet bowl and initiating a flush cycle in response to the sensed contents of the bowl. As illustrated in FIG. 3, the system 100 includes a pedestal 110 including a bowl 111 having a sump 112. The pedestal 110 further includes a trapway 113. In some examples, the pedestal may further include a jet solenoid 114 and a rim solenoid 115. The system 100 may further include a first photogate 120 including a first emitter 121 and a first detector 122 electrically connected to a controller 130. The controller 130 may include a comparison module 131, a selection module 132, and a tracking module 133.

The pedestal 110 may be the same as the pedestal or base 21 as described above with respect to FIGS. 1 and 2. The bowl 111 may be the same as the bowl 23 described above with respect to FIGS. 1 and 2. The bowl 111 includes a receptacle or sump 112 disposed at the bottom of the bowl 111. The sump may be configured to receive or collect waste before waste is expelled through the trapway 113 and ultimately to a drain pipe during a flush cycle. The trapway 113 may be the same as the trapway 15 described above with respect to FIGS. 1 and 2.

In some examples, the pedestal 110 may further include a jet solenoid 114 and/or a rim solenoid 115. The jet solenoid 114 may be a solenoid valve configured to control a flow of water through a sump jet disposed in the sump 112 into the bowl 111. The jet solenoid 114 may control a flow of water from a reservoir (e.g., tank) of a toilet or from an in-line water supply (e.g., plumbing network) into the bowl 111. The rim solenoid 115 may be a solenoid valve configured to control a flow of water through one or more rim outlets disposed near the top of the bowl 111 into the bowl 111. The rim solenoid 115 may control a flow of water from a reservoir (e.g., tank) of a toilet or form an in-line water supply (e.g., plumbing network) into the bowl 111.

The first photogate 120 includes a first emitter 121 and a first detector 122. The first emitter 121 may be configured to emit light into the sump 112 and the first detector may be configured to detect (e.g., an intensity of) light within the sump 112. In some examples, the first detector 122 may include a phototransistor and a circuit configured to identify specific changes in light (e.g., intensity) and return a digital value indicating whether or not waste is detected. In some examples, the sensitivity of phototransistor may be adjusted to detect presence of different contents (e.g., urine, toilet paper, solid fecal matter, etc.) in the sump 112. According to some examples of the present disclosure, the first detector 122 may be configured to detect an attenuation of light emitted by the first emitter 121.

Figure 4:
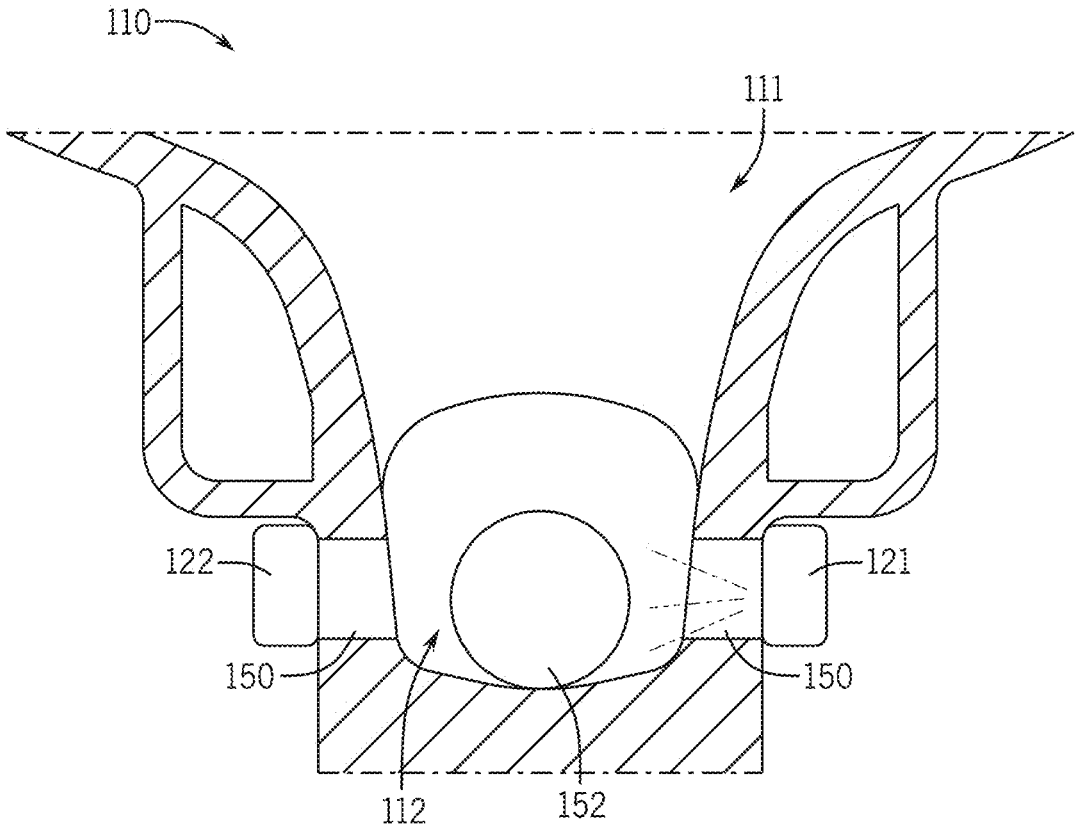
FIG. 4 illustrates a partial view of a toilet according to an exemplary embodiment of the present disclosure.

Referring to FIG. 4, the first emitter 121 and the first detector 122 may be disposed adjacent to the sump 112. In some examples, as illustrated in 4, the first emitter 121 and the first detector 122 may be disposed across from one another so as to be on opposite sides of the sump 112. As illustrated in FIG. 4, the bowl 111 may include one or more transparent windows 150 adjacent to the sump 112. A window 150 may be disposed adjacent to the first emitter 121 allowing light to travel from the first emitter 121 through the window 150 and into the sump 112. Additionally, a window may be disposed adjacent to the first detector allowing light to travel from the sump 112 to the first detector 122.

The first emitter 121 may be configured to emit light into the sump 112. The first emitter 121 may be configured to emit light having various wavelengths. In some examples, the first emitter 121 may emit infrared light. In other examples, the first emitter may emit visible light or ultraviolet light. In some examples, the first emitter 121 may emit light of a predetermined, known intensity into the sump 112. In some examples, the first emitter 121 may continuously emit light into the sump 112. In other examples, the first emitter may intermittently emit light into the sump, for example, in a series of pulses. The first emitter 121 may be configured to emit light having the same or a constant intensity (e.g., when light is emitted intermittently).

The first detector 122 may be configured to detect the light emitted by the first emitter 121. Specifically, the detector may be configured to detect or observe an intensity of light in the sump 112 including light emitted by the first emitter 121. The first detector 122 may be configured to detect the intensity of light in the sump 112 including light emitted by the first emitter 121 after the light emitted by the first emitter 121 has traveled across the sump 112. In some examples, for example, when no waste has been deposited into the bowl 111, the sump may include only water. These examples, the light emitted by the first emitter 121 may travel from the first emitter 121, through a first window 150, through the water disposed in the sump 112, through a second window 150 to the first detector 122. In other examples, for example, when waste 152 has been deposited into the bowl 111, the light emitted by the first emitter 121 may contact the waste (e.g., urine, fecal matter) 152 and/or toilet paper in the sump 112. The presence of either waste or toilet paper in the sump 112 may cause a reduction in intensity or attenuation of the light detected by the first detector 122. In other words, the presence of waste 152 or toilet paper may cause the first detector 122 to detect a light intensity that is (e.g., substantially) less than the light intensity observed when no obstruction or waste is present in the toilet bowl. Accordingly, the first detector 122 may detect or observe a change or attenuation in light intensity in the sump 112 that may be attributed to the presence of waste in the sump 112. Thus, when the first emitter 121 emits light of a constant intensity a threshold may be set for a particular waste object (e.g., urine, toilet paper, solid waste). For example, a threshold may be set with respect to either the detected light intensity or a magnitude of attenuation of the light. If the light intensity detected exceeds the threshold or a magnitude of attenuation is less than the threshold, it may be determined that the sump 112 does not contain the particular waste object for which the threshold was set. Conversely, if the intensity of light detected is less than the threshold or the magnitude of attenuation is greater than the threshold, it may be determined that the sump 112 does contain the particular waste object for which the threshold was set. Different thresholds may be set to detect the presence of different waste objects (e.g., urine, toilet paper, solid waste) in the sump 112.

Returning to FIG. 3, the first photogate 120 may be electrically connected to the controller 130. In some examples, where the first emitter intermittently emits light into the sump 112, the controller 130 may provide electric current and/or control signals to the first emitter 121, causing the first emitter 121 to emit light. In some examples, the controller may send control signals to the first emitter 121 indicating a wavelength and/or intensity of light to be emitted by the first emitter 121. In some examples, the photogate may be configured to determine a duration of time during which specific contents (e.g., water, urine, toilet paper, solid fecal matter) are present in the sump.

The controller 130 may include a comparison module 131, a selection module 132, and a tracking module 133. The comparison module 131 may be configured to compare an intensity of the light emitted by the first emitter 121 and an intensity of the light detected by the first detector 122 or compare an intensity of light detected by the first detector 122 to a known intensity of light detected by the first detector 122 when the first emitter 121 emits light and only water is disposed in the sump to determine an attenuation of the light emitted by the first emitter 121. For example, the comparison module 131 may be configured to determine a difference between the intensity of the light emitted by the first emitter 121 and the intensity of the light detected by the first detector 122. In some examples, the wavelength and/or intensity of light emitted by the first emitter may be known and the comparison module 131 may subtract the intensity of the light detected by the first detector 122 from the known intensity of light emitted by the first emitter 121. In other examples, as noted above, the first emitter 121 may emit light of constant intensity and the intensity of light detected by the first detector 122 may be compared to a known or reference intensity of light detected by the first detector 122 when only water is present in the sump 112.

The magnitude of a difference or change in the intensity of light in the sump 112 detected by the first detector 122 may be indicative of the contents of the sump 112. The presence of different contents in the sump 112 may cause different attenuations or reductions in magnitude of the intensity of light emitted by the first emitter 121 as the light travels through the sump 112 to the first detector 122. For example, a smallest (e.g., relatively smallest) difference or attenuation between the intensity of the emitted light and the intensity of the detected light may occur when only water is present in the sump 112. A small (e.g., relatively larger than the smallest) difference or attenuation between the intensity of emitted light and the intensity of detected light may occur when there is urine present in the sump 112. A medium (e.g., relatively larger than the small) difference or attenuation between the intensity of the light emitted and the intensity of the light detected may occur when there is toilet paper in the sump 112. A large (e.g., relatively largest) difference or attenuation in the intensity of the light emitted and an intensity of the light detected may occur when there is solid fecal matter present in the sump 112. Various thresholds may be set according to the above described relative magnitudes of attenuation to identify the corresponding type of waste.

Additionally, in some examples, a quantity of the different contents may correspond to a magnitude of attenuation of the intensity of the light emitted by the first emitter 121. For example, a relatively large amount of toilet paper in the sump 112 may cause a relatively large attenuation as compared to a relatively small amount of toilet paper in the sump 112. The same may be true for urine and/or solid fecal matter.

The selection module 132 may receive a difference or attenuation in intensity of light emitted from the first emitter 121 and intensity of light detected by the first detector 122 as determined by the comparison module 131 (e.g., determined by comparing a light intensity detected by the first detector 122 to a known light intensity detected by the first detector 122 when only water is present in the sump). The selection module 132 may be configured to select an operational or flush cycle from various different flush cycles based on the difference in light intensity received from comparison module 131. The flush cycle selected by the selection module 132 may be initiated in response to actuation of an actuator (e.g., button, lever, sensor) by a user.

The various flush cycles may release differing volumes of water. Accordingly, for example, when a small (e.g., relatively small) difference in in intensity of light, indicative of the presence of only urine in the sump 112 is received from the comparison module 131, the selection module may select a flush cycle using a relatively low volume of water. Selecting a flush cycle using a relatively low volume of water may reduce water consumption while still evacuating the contents of the bowl. For example, a flush including a volume of water that would not be sufficient to evacuate fecal matter from the bowl may be used when the difference in light intensity is indicative of the presence of only urine in the bowl.

In other examples, when a large (e.g., relatively large) difference in intensity of light, indicative of the presence of solid fecal matter and/or a substantial amount of toilet paper in the sump 112 is received, the selection module may select a flush cycle using a relatively large volume of water. In such a circumstance, the selection module 132 may determine that a flush cycle using a relatively large volume of water is necessary to evacuate the contents of the bowl.

The selection module 132 may use a look-up table, a series of predetermined thresholds, or the like to select a flush cycle based on the difference in light intensity received from the comparison module 131. In some examples, the various flush cycles may include different ratios or percentages of the volume of water released from a rim or sump jet of the toilet. For example, when a relatively small difference in light intensity, indicative of only urine in the sump is received from the comparison module 131, a flush cycle in which a relatively large portion of the total volume of water used is released from the sump jet (e.g., jet solenoid 114) may be selected, as it may be determined that a relatively small amount of water is needed for bowl rinse. In other examples, when a relatively large difference in light intensity, indicative of solid fecal matter and/or toilet paper is received from the comparison module 131, a flush cycle with relatively large portion of the total volume of water used being released from the rim (e.g., rim solenoid 115) may be selected.

In some examples, the selection module 132 may perform a series of steps to determine the contents of the sump 112 and select a flush cycle. In a first step, the sensitivity of the first photogate 120 may be set to detect the presence of only liquids in the sump 112. If only liquids are detected in the sump, the selection module 132 will select a flush cycle for only liquids (e.g., low-volume flush). If something other than a liquid is detected, in a second step the first photogate 120 may be set to detect the presence of toilet paper in the sump 112. If only urine and toilet paper are detected, the selection module 132 may select a flush cycle of only urine and toilet paper (e.g., medium-volume flush). If something other than urine and toilet paper are detected in the sump, in a third step the first photogate 120 may be set to detect the presence of solid waste in the sump 112. If solid waste is detected in the sump 112, the selection module 132 may select a flush cycle for solid waste (e.g., high-volume flush).

In some examples, the system 100 may further include a second photogate 140. The second photogate 140 may be connected to the controller 130. The second photogate 140 may include a second emitter 141 and a second detector 142. The second emitter 141 may be the same as the first emitter 121 and the second detector 142 may be the same as the first detector 122. The second photogate 140 may be disposed at a different location in the pedestal 110 of the bowl than the first photogate 120. For example, the second photogate may be disposed adjacent to the trapway 113 of the toilet.

Figure 5:
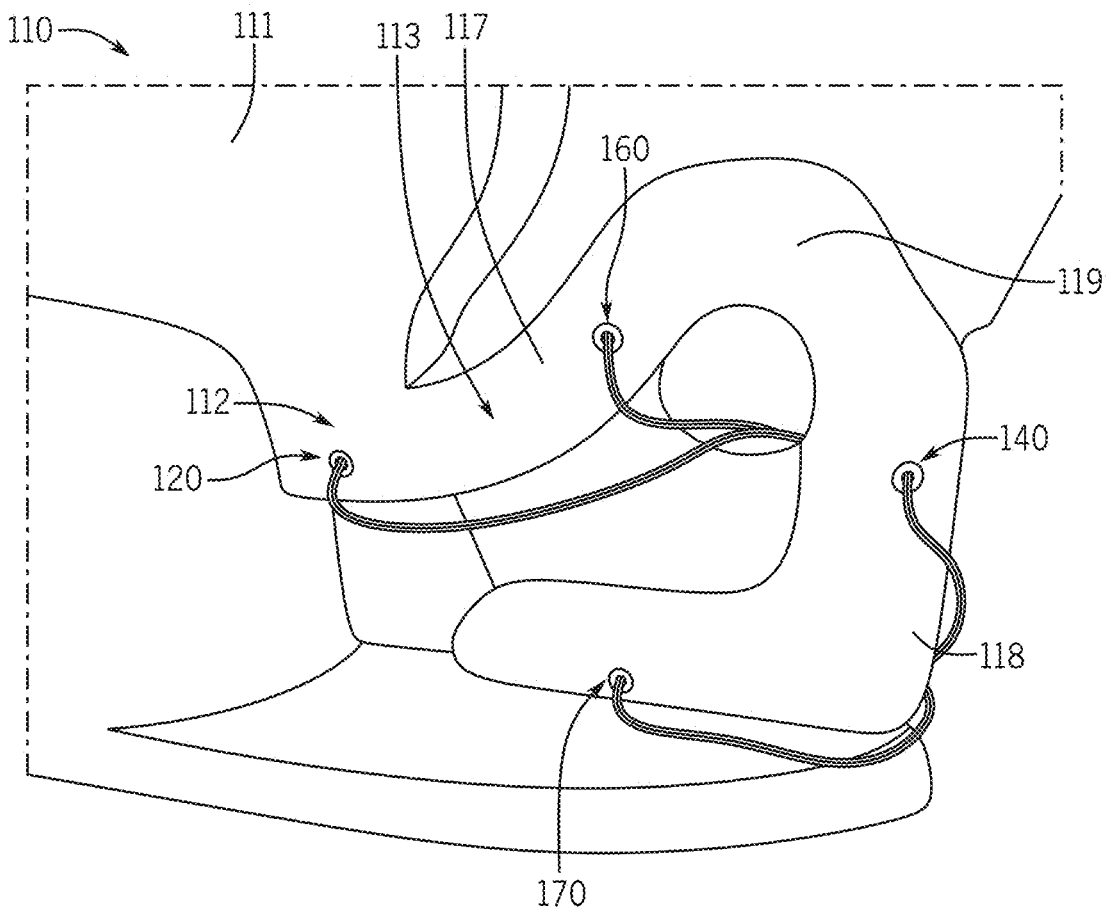
FIG. 5 illustrates a partial side view of a toilet according to an exemplary embodiment of the present disclosure.

Referring to FIG. 5, in some examples, more than two photogates may be included in the pedestal 110. As illustrated in FIG. 5, a pedestal 110 includes a first photogate 120 adjacent to the sump 112 and a second photogate 140, a third photogate 160, and a fourth photogate 170 adjacent to the trapway 113 at different locations along the length of the trapway 113. In some examples, the first photogate 120 may be configured to determine the contents of the sump 112 and the second photogate 140, third photogate 160, and fourth photogate 170 may be configured to track waste as it moves through the trapway 113 during a flush cycle of the toilet. The third photogate 160 may include a third emitter and a third detector and the fourth photogate 170 may include a fourth emitter and a fourth detector. The third emitter and the fourth emitter may be the same as the first emitter 121 described above. Similarly, the third detector and the fourth detector may be the same as the first detector 122 described above. As illustrated in FIG. 5, only one side of the pedestal 110 is shown, accordingly only half (e.g., emitter or detector) of each photogate 120, 140, 160, and 170 is shown. The other half (e.g., emitter or detector) of each photogate 120, 140, 160, and 170 may be disposed on an opposite side of the pedestal 110 (e.g., across the sump 112 or trapway 113).

As illustrated in FIG. 5, the trapway 113 may include a first portion 117, a second portion 118, and a weir 119 separating the first portion 117 and the second portion 118. The first portion 117 of the trapway 113 may extend from the sump at an upwardly oblique angle to the weir 119. The second portion 118 of the trapway 113 may extend from the weir 119 downwardly to an exiting device such as a drain pipe or soil pipe.

In some examples, as illustrated in FIG. 5, the second photogate 140 may be located in the second portion 118 of the trapway 113. The second photogate 140 may be configured to detect the presence of waste, as waste flows through the trapway (e.g., the second portion 118 of the trapway) during a flush cycle of the toilet. The comparison module 131 may be configured to compare an intensity of light emitted by the second emitter 141 and an intensity of light detected by the second detector 142 and determine a difference or attenuation in the intensity of the light emitted and detected by the second photogate 140. The tracking module 133 may be configured to compare the attenuation (e.g., a maximum attenuation) of the first photogate and the attenuation (e.g., a maximum attenuation) of the second photogate 140 to determine whether the contents of the sump 112 identified by the first photogate 120 have traveled through or past the second photogate 140. The maximum attenuation as described above may be a maximum attenuation for a preset period of time that corresponds to a single use of the toilet.

Accordingly, the second photogate 140 may be used to determine whether or not waste has traveled through the second photogate 140 during a flush cycle. In some examples, it may be determined that the waste, identified in the sump 112 by the first photogate 120, has traveled through the second photogate 140 and thus very likely has flown out of the trapway and into a drain pipe. When it is determined that the waste identified in the sump has traveled through the second photogate the system 100 may take no further action after completion of the selected flush cycle. In other examples, when it is determined that the waste identified in the sump 112 by the first photogate 120 has not flown past the second photogate 140 during the flush cycle, an additional or subsequent flush cycle may be initiated after completion of the initially selected flush cycle. The additional or subsequent cycle may be selected by the controller (e.g., the selection module 132 or tracking module 133).

In some examples, as illustrated in FIG. 5, additional photogates may be included. For example, as illustrated in FIG. 5, a third photogate 160 and a fourth photogate 170 may be included. The tracking module 133 may be configured to compare the attenuation (e.g., maximum attenuation) at the first photogate 120 to the attenuation (e.g., maximum attenuation) at each of the second photogate 140, third photogate 160, and fourth photogate 170 to determine which, if any, of the photogates the contents (e.g., urine, toilet paper, solid fecal matter, etc.) sensed or identified in the sump have traveled through. The inclusion of additional photogates may help to more specifically identify the location of a blockage in the trapway 113. Similarly, as described above with respect the second photogate 140, if it is determined that the contents or waste identified in the sump 112 by the first photogate 120 have not traveled through the third photogate 160 and/or fourth photogate 170, an additional or subsequent flush cycle may be initiated.

In some examples, the toilet may be an inline toilet and water may be continuously supplied to the toilet (e.g., through a jet solenoid 114 and/or rim solenoid 115) until the waste identified in the sump 112 by the first photogate 120 has traveled through any subsequent photogates (e.g., 140, 160, 170) in the trapway 113. In these examples, the controller may include a cut off to comply with maximum volume of water per flush code requirements. Additionally, in some examples, the controller may include a cut off preventing the toilet from overflowing if a predetermined volume of water is supplied to the toilet and the waste has not yet traveled through all subsequent photogates.

Figure 6:
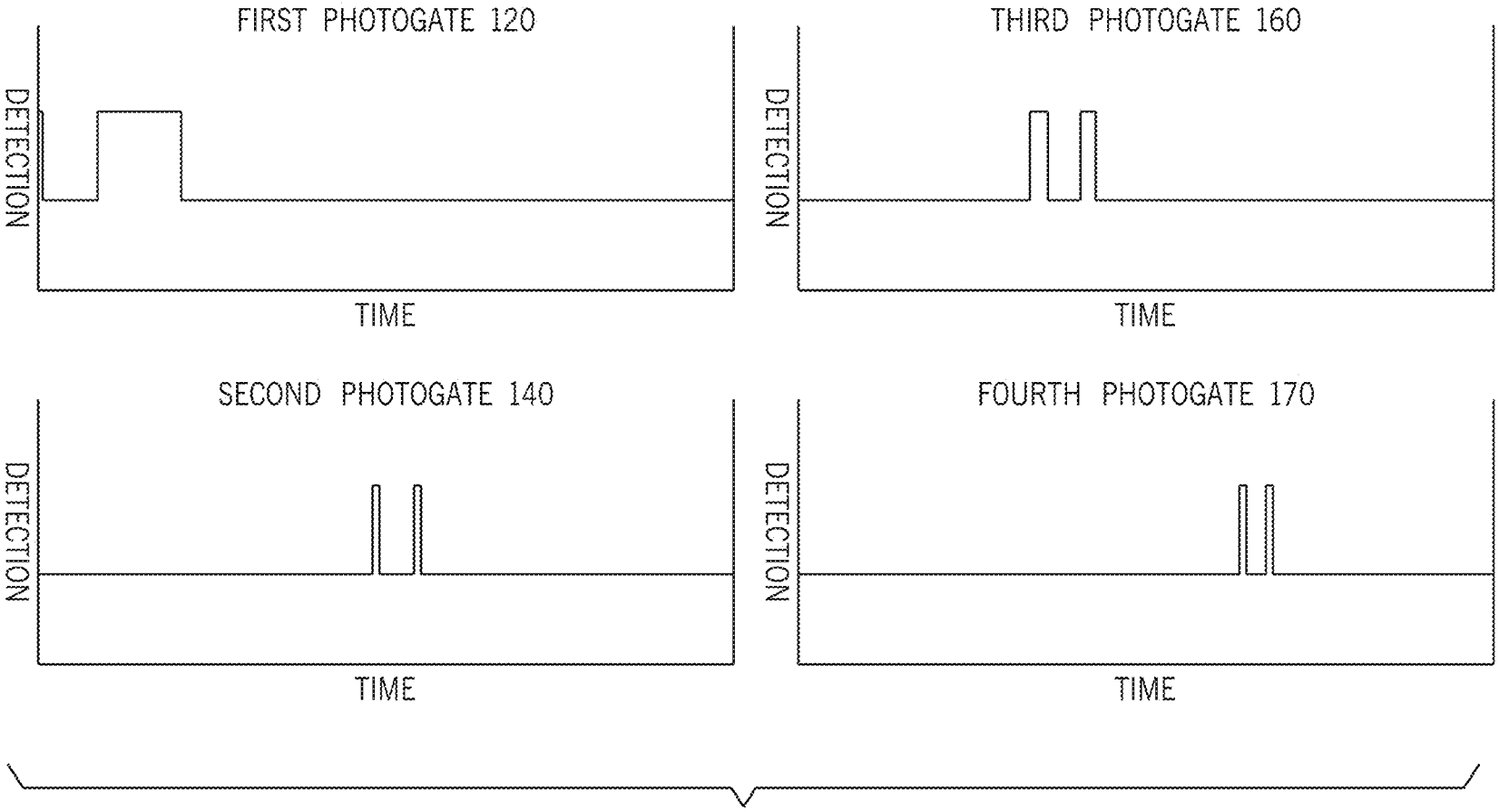
FIG. 6 illustrates a series of graphs illustrating waste traveling through a trapway according to an exemplary embodiment of the present disclosure.

Referring to FIG. 6, a series of graphs for each of the first photogate 120, the second photogate 140, the third photogate 160, and the fourth photogate 170 are illustrated. Each of the graphs includes detection on the y-axis and time on x-axis. The detection of the axis may represent a difference or attenuation between the light emitted and the light detected of the respective photogate corresponding to the presence of something other than just water within the respective photogate. For example, the detection may represent an attenuation corresponding to the presence of solid fecal matter between the identified photogate. In other examples, the detection may represent an attenuation corresponding to toilet paper, urine, or the like between the identified photogate.

Accordingly, FIG. 6 illustrates waste traveling through each of the photogates 120, 140, 160, and 170 during a flush cycle. As shown in FIG. 6, during a flush cycle the waste may first be detected by the first photogate 120 disposed in the sump 112 of the toilet. The waste may then be detected by a third photogate 160 disposed, for example, in the first portion 117 of the trapway 113. After being detected by the third photogate 160, the waste may subsequently be detected by the second photogate 140 disposed, for example, in the second portion 118 of the trapway 113. After being detected by the second photogate 140, the waste may subsequently be detected by the fourth photogate 170, for example, in the second portion 118 of the trapway 113 downstream of the second photogate 140. In some examples, the waste may increase in speed as it travels through the third photogate 160, the second photogate 140, and the fourth photogate 170. Accordingly, the duration of time in which the waste is detected by the fourth photogate 170 may be less than the duration of time in which the second photogate 140 detects the waste. Similarly, the duration of time in which the second photogate 140 detects the waste may be less than the duration of time in which the third photogate 160 detects the waste.

Figure 7:
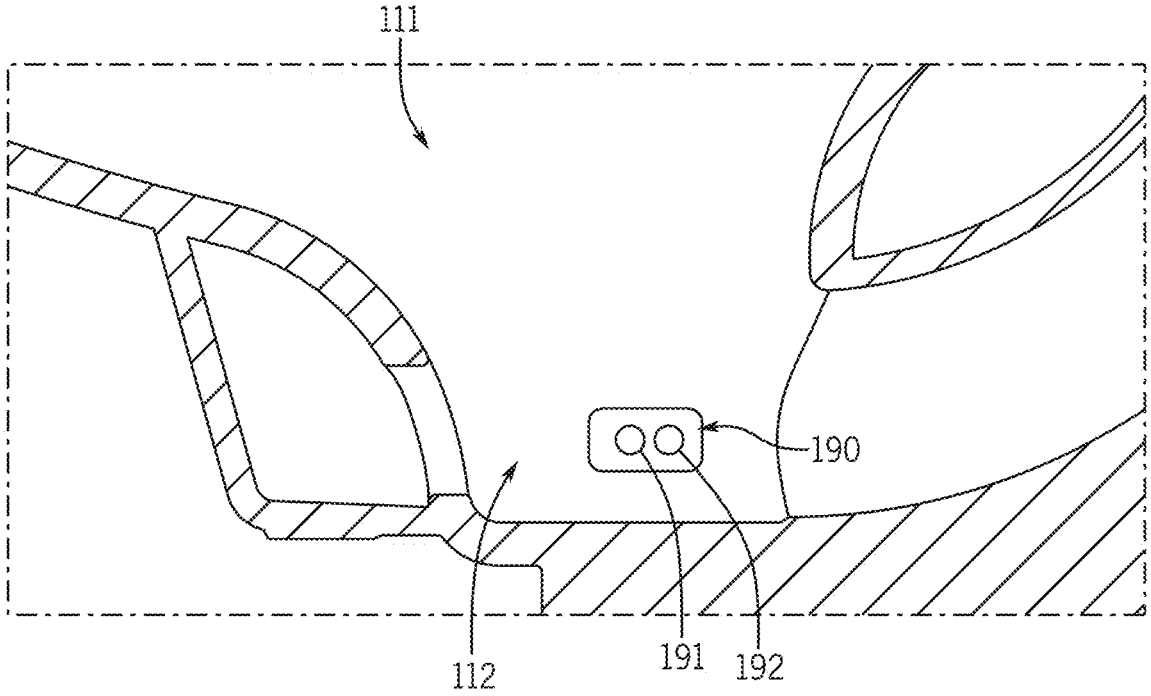
FIG. 7 illustrates a partial cross-section view of a toilet according to an exemplary embodiment of the present disclosure.

In some examples, as illustrated in FIG. 7, a photogate 190 may include an emitter 191 and a detector 192 disposed on the same side of the sump 112 of the toilet. In these examples, light emitted by the emitter 191 may be reflected off of the wall (e.g., a white vitreous wall) of the sump 112 across from the photogate 190. In some examples, a reflective material may be provided within the sump 112 across from the photogate. Similarly, an emitter 191 and a detector 192 may be disposed on the same side of the trapway of the pedestal 110.

Other than the emitter 191 and the detector 192 being on the same side of the sump 112 or trapway 113, the photogate 190 may be the same as the first photogate 120 described above. Any of the photogates 120, 140, 160, and 170 describe above may be a photogate 190 including an emitter 191 and a detector 192 disposed on the same side of the sump 112 or the trapway 113 as illustrated in FIG. 7.

Figure 8:
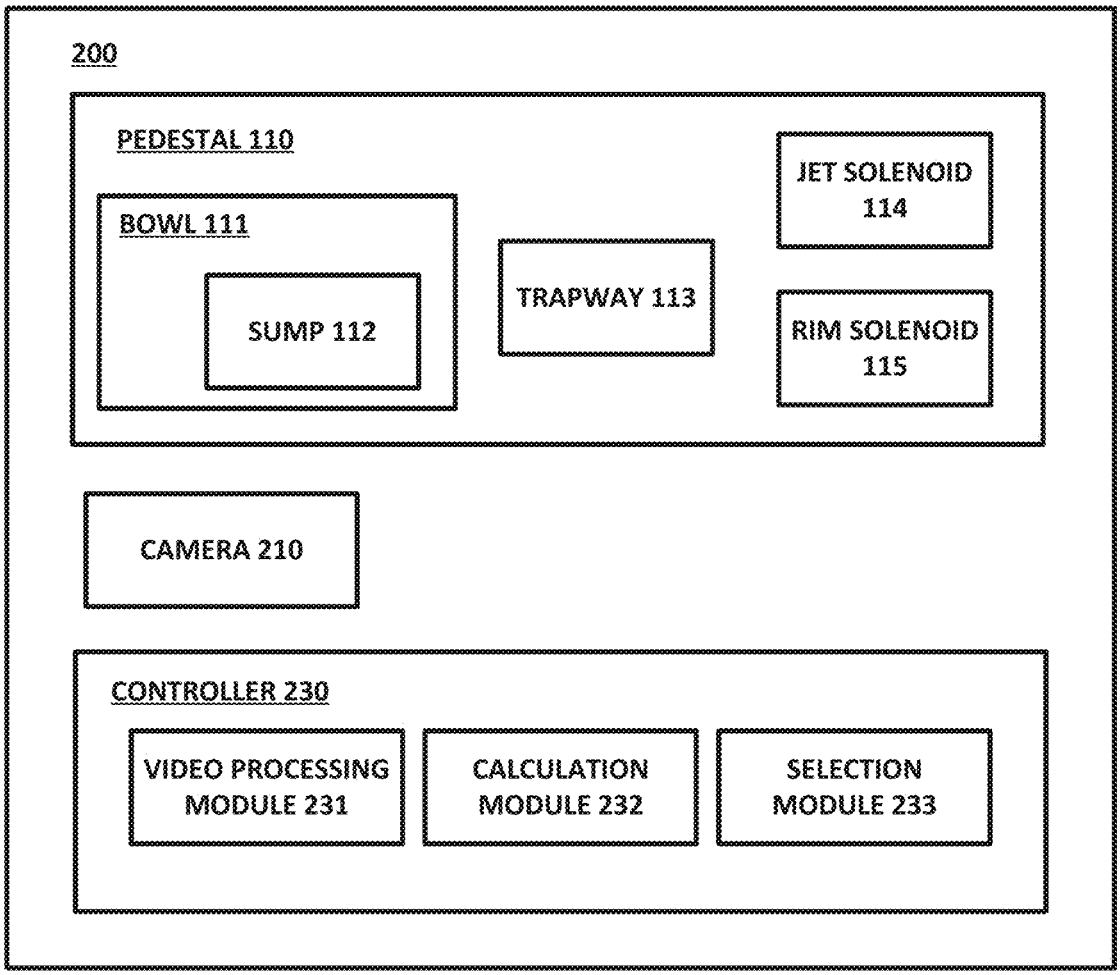
FIG. 8 illustrates a system for sensing the contents of a sump according to an exemplary embodiment of the present disclosure.

Referring to FIG. 8, a system 200 for sensing the contents of a toilet bowl and initiating a flush cycle in response to the sensed contents of the bowl is illustrated. As illustrated in FIG. 8, the system includes a pedestal 110 including a bowl 111 having a sump 112. The pedestal 110 further includes a trapway 113. In some examples, the pedestal 110 may further a jet solenoid 114 and a rim solenoid 115. The pedestal 110, bowl 111, sump 112, trapway 113, jet solenoid 114, and rim solenoid 115 may be the same as those discussed above with respect to FIG. 3.

The system 200 further includes a camera 210 having a field of view including the sump 112 of the toilet. In some examples, the camera 210 may be a visible light camera. In other examples, the camera 210 may be an infrared camera. In some examples, when the camera is a visible light camera, the system 200 may further include a visible spectrum light configured to illuminate the sump when the toilet is used when it is dark (e.g., at night). In other examples, when the camera 210 is an infrared camera, the system 200 may further include an infrared spectrum light configured to illuminate the same when it is dark. In some examples, the camera 210 may continuously capture images of the sump 112. In other examples, the camera 210 may only capture images of the sump in response to detection of a user within a proximity of the toilet.

Figure 9:
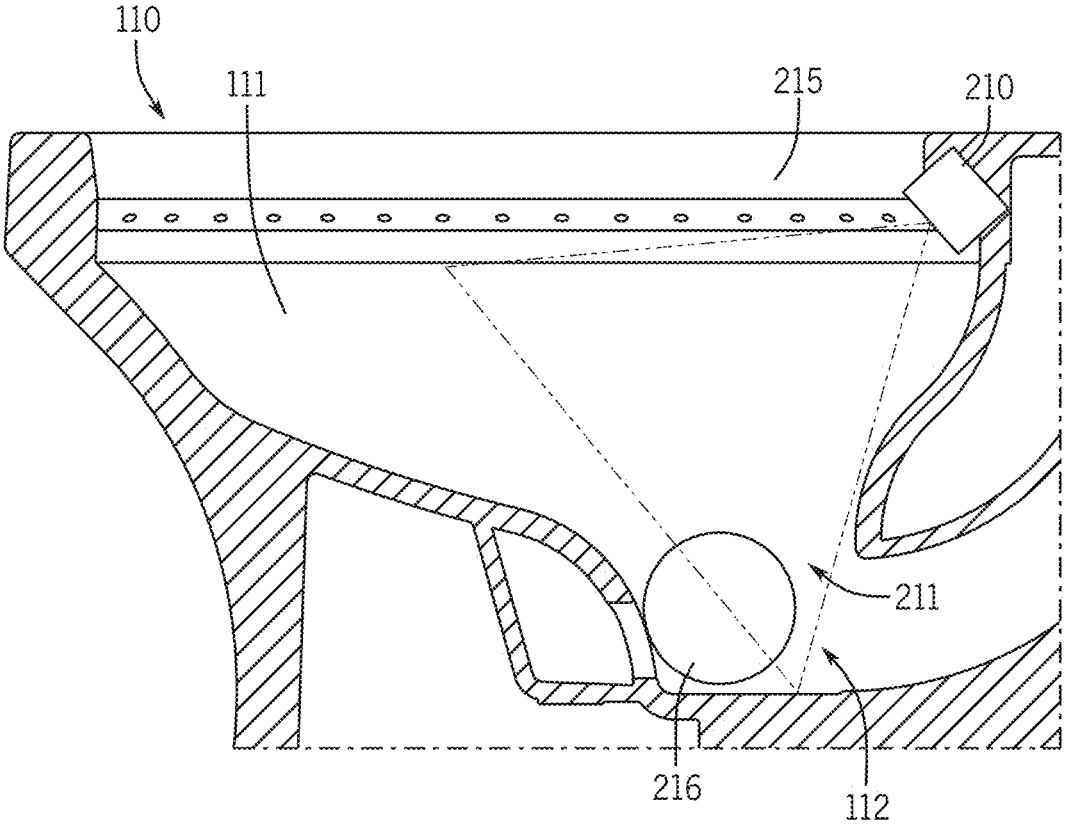
FIG. 9 illustrates a partial cross-section view of a toilet according to an exemplary embodiment of the present disclosure.

Referring to FIG. 9, a camera 210 including a field of view 211 including the sump 112 is illustrated. Accordingly, when solid waste 216 is present in the sump 112, the field of view of the camera 210 may include the solid waste 216 disposed in the sump 112. The location of the camera 210 may vary. For example, referring to FIG. 9, in some examples, the camera 210 may be disposed at or below a rim 215 in the pedestal 110 of a toilet. In other examples, the camera 210 may be disposed on a bottom surface of a toilet seat coupled to the pedestal 110. In some examples, the camera 210 may be disposed between rim 215 and a bottom surface of a seat coupled to the pedestal 110. In yet other examples, the camera 210 may be disposed in the sump 112.

Returning to FIG. 8, the camera 210 may be connected to the controller 230 and configured to provide the video (e.g., images) captured by the camera 210 to the controller 230. The controller 230 may include a video processing module 231, a calculation module 232, and a selection module 233. The video processing module 231 may be configured to perform video processing on the video (e.g., images) received from the camera 210.

The video processing module 231 may process the video (e.g., images) captured by the camera 210 to identify the contents of the sump 112. Specifically, the video processing module 231 may process the video captured by the camera 210 to identify solid waste, for example, solid fecal matter or toilet paper, in the sump 112. The video processing module 231 may continuously monitor for solid waste 216 in the sump 112. The processing module 231 may identify solid waste in the sump using the color of the solid waste in the video captured by the camera 210. In some examples, the video processing module may distinguish between solid fecal matter and toilet paper based on the respective colors of the solid fecal matter and the toilet paper.

The video processing module 231 may process the images captured by the camera 210 before identifying the solid waste. For example, the video processing module 231 may convert the images captured by the camera 210 into black and white images. In some examples, the video processing module 231 may invert the color of the images captured by the camera 210. In some examples, the video processing module 231 may determine an outer profile or contour of what is determined to be solid waste.

Figure 10:
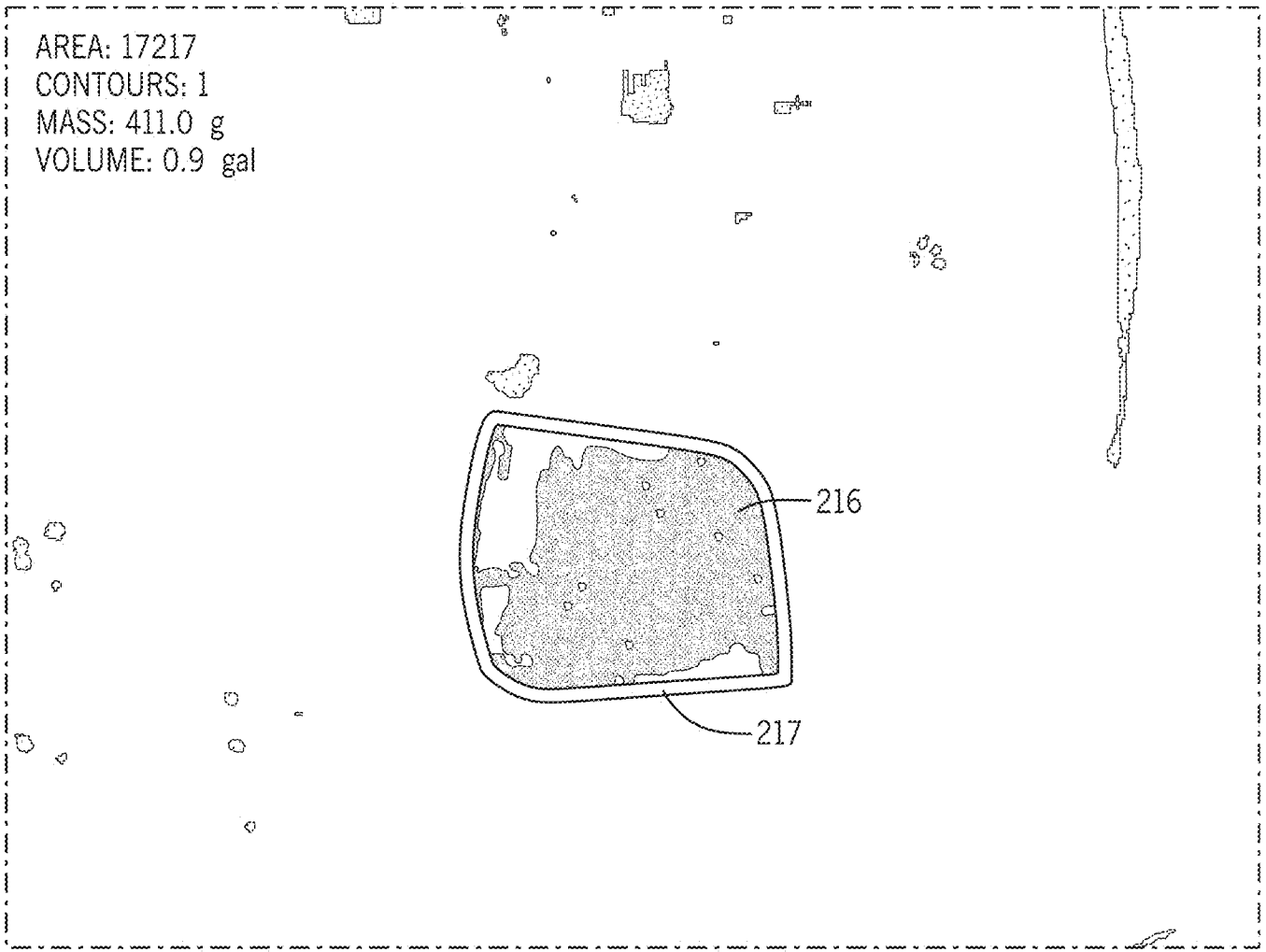
FIG. 10 illustrates a processed image of a sump according to an exemplary embodiment of the present disclosure.

Referring to FIG. 10, an image of a camera 210 processed by the video processing module 231 is illustrated. The image as illustrated in FIG. 10 has been processed so as to be in black and white and then inverted by the video processing module 231. Additionally, the video processing module 231 has determined a contour or outer profile 217 of solid waste 216 in the sump 112.

Returning to FIG. 9, the controller 230 may further include a calculation module 232. The calculation module 232 may be configured to calculate an area within the contour or outer profile 217 of the identified solid waste 216. In some examples, the calculation module 232 may calculate the area of the of the waste in pixel units. In some examples, the camera 210 may be calibrated so as to calculate the area of the within the contour in metric and/or standard units (e.g., $in^2$, $ft^2$, $cm^2$, $m^2$).

The controller 230 may further include a selection module 233 configured to select a flush cycle. The selection module 233 may be configured to select a flush cycle using the area of solid waste 216 within contour 217 as calculated by the calculation module 232. In some examples, the selection module 233 may use a look up table or one or more predetermined thresholds to select a flush cycle. In some examples, a volume of water required to evacuate a certain area of solid waste in the sump 112 as determined by the calculation module 232 may be identified. In these examples, the identified volume of water to evacuate a specific area of waste may be used to select a flush cycle using only the required amount of water or to select a flush cycle (e.g., among a plurality of predetermined flush cycles) using the smallest volume of water greater than or equal to the volume of water required to evacuate the calculated area of waste. In other examples, the area of the solid waste as calculated by the calculation module 232 may be associated with a volume of solid waste, and the volume of the solid waste may be associated with a volume of water required to evacuate the volume of the solid waste from the bowl 111.

Similar to the selection module 132 as described above with respect to FIG. 3, the selection module 233 may select a flush cycle amongst various flush cycles using different volumes of water. Accordingly, a flush cycle including a smallest volume of water that is adequate to evacuate the contents of the bowl 111 may be selected. For example, when a relatively large area of solid waste is present in the sump 112, a relatively large volume of water may be required to evacuate the contents of the bowl 111, and a flush cycle including a relatively large volume of water may be selected. Conversely, when a relatively small area or no area of solid waste is identified, a relatively small volume of water may be required to evacuate the contents of bowl 111, and a flush cycle including a relatively small volume of water may be selected.

In some examples, the various flush cycles may include different ratios or percentages of the volume of water released from a rim or sump jet of the toilet. For example, when a relatively small area or no area of solid waste is calculated by the calculation module 232, a flush cycle in which a relatively large portion of the total volume of water used is released from the sump jet (e.g., jet solenoid 114) may be selected, as it may be determined that a relatively small amount of water is needed for bowl rinse. In other examples, when a relatively large area of solid waste is calculated by the calculation module 232, a flush cycle with relatively large portion of the total volume of water used being released from the rim (e.g., rim solenoid 115) may be selected.

In some examples, during use of the toilet, solid fecal matter may be deposited into the bowl and toilet paper may subsequently cover (e.g., exist between the camera 210 and the solid fecal matter) preventing images captured by the camera 210 from including the solid fecal matter. Accordingly, in some embodiments, the controller 230 may further include memory configured to store the images captured by the camera 210 and processed by the video processing module 231. In these examples, the controller (e.g., the selection module 233) may be configured to access the stored images to determine a quantity of solid fecal matter present in the sump 112 before any toilet paper is deposited into the sump 112. Accordingly, the selection module 233 may select a flush cycle using an accurate accounting of solid fecal matter in the sump 112, including solid fecal matter subsequently covered by toilet paper.

Figure 11:
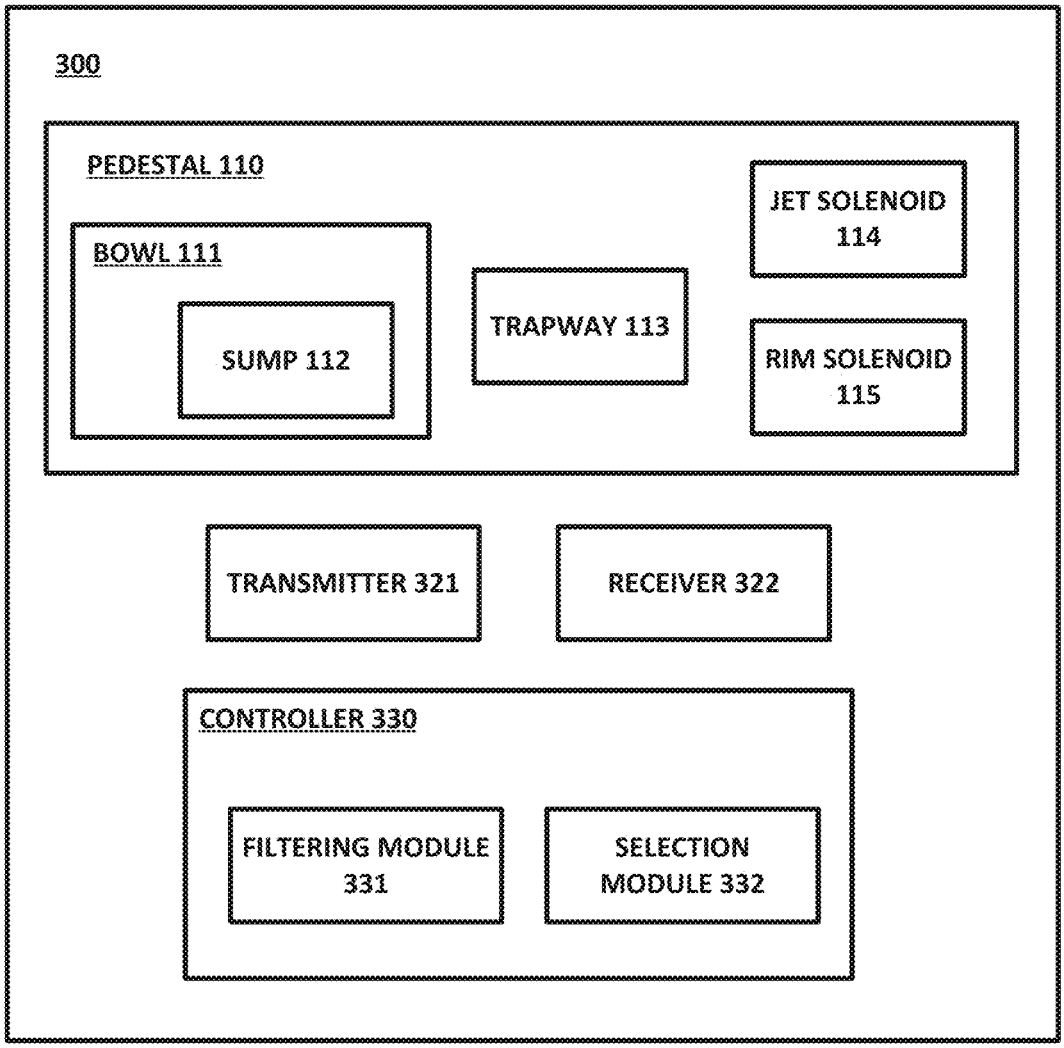
FIG. 11 illustrates a system for sensing the contents of a sump according to an exemplary embodiment of the present disclosure.

Referring to FIG. 11, a system 300 for sensing the contents of a toilet bowl and initiating a flush cycle in response to the sensed contents of the bowl is illustrated. As illustrated in FIG. 11, the system includes a pedestal 110 including a bowl 111 having a sump 112. The pedestal 110 further includes a trapway 113. In some examples, the pedestal 110 may further a jet solenoid 114 and a rim solenoid 115. The pedestal 110, bowl 111, sump 112, trapway 113, jet solenoid 114, and rim solenoid 115 may be the same as those discussed above with respect to FIG. 3.

Figure 12:
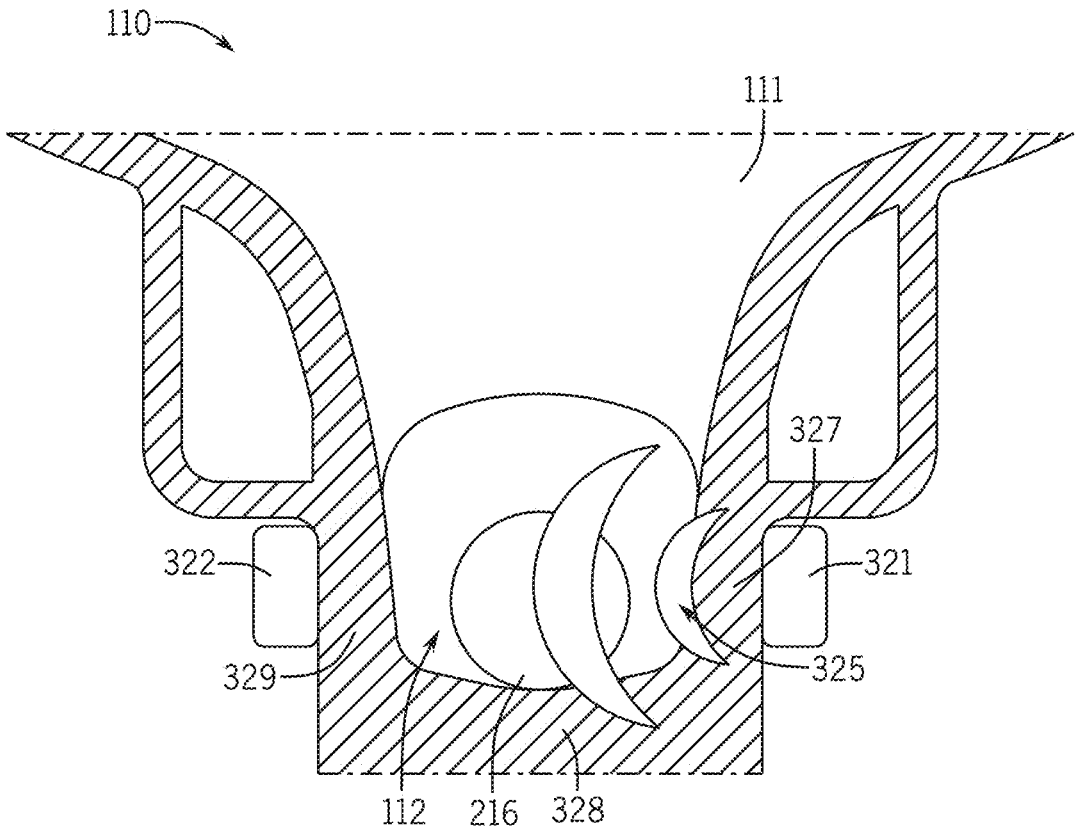
FIG. 12 illustrates a partial cross-section view of a toilet according to an exemplary embodiment of the present disclosure.

The system 300 may further include an ultrasonic transmitter 321, an ultrasonic receiver 322, and a controller 330. Referring to FIG. 12, the ultrasonic transmitter 321 may be disposed adjacent to the sump 112. For example, as illustrated in FIG. 12, the transmitter 321 may be attached or coupled to an exterior surface of pedestal 110 adjacent to the sump 112. The ultrasonic transmitter 321 is configured to transmit (e.g., emit, produce) an ultrasonic pulse 325 in the direction of the sump 112.

Further, as illustrated in FIG. 12, the system includes an ultrasonic receiver 322. The receiver 322 may be located on an opposite side of the sump 112 as the transmitter 321 and may be configured to receive (e.g., detect, sense) the ultrasonic pulse 325 transmitted by the transmitter 321. The locations of the transmitter 321 and receiver 322 may vary. In some examples, one of the transmitter 321 and receiver 322 may be disposed on a left side of the sump 112 and the other of the transmitter 321 and the receiver 322 may be disposed on a right side of the sump 112. In other examples, one of the transmitter 321 and receiver 322 may be disposed at a front of the sump 112 and the other of the transmitter 321 and the receiver 322 may be disposed at a back of the sump 112.

The ultrasonic pulse emitted by the transmitter 321 may be used to determine the presence of waste in the sump 112. For example, material properties and/or testing may be used to determine a time required for the ultrasonic pulse to travel from the transmitter 321 through a first wall 327 of the sump 112, through a sump 112 including only water, and through a second wall 329 of the sump 112. This period of time may be stored as a reference time. The presence of solid waste in the sump 112 may reduce the velocity at which the ultrasonic pulse travels through the sump 112. Accordingly, when a period of time for the ultrasonic pulse to travel from the transmitter 321, through the first wall 327 of the sump, through the sump 112, and through the second wall 329 of the sump 112 to the receiver 322, is longer than the reference time, it may be determined that something other than water (e.g., solid waste) is present in the sump 112. In some examples, a difference between a reference time for the ultrasonic pulse to travel through the sump including only water and a measured time for the ultrasonic pulse to travel through the sump may be used to determine a quantity of solid waste in the sump 112.

Returning to FIG. 11, the transmitter 321 and the receiver 322 may be connected to the controller 330. In some examples, the controller 330 may control when an ultrasonic pulse is transmitter by the transmitter 321 by sending one or more control signals and/or electric current to the transmitter 321. The controller 330 includes a filtering module 331 and a selection module 332.

When an ultrasonic pulse is transmitted by the transmitter 321, the ultrasonic pulse may travel along two distinct paths between the transmitter 321 and the receiver 322. Returning to FIG. 12, the ultrasonic pulse may travel along a first path from the transmitter 321 through a first wall 327 of the sump 112, through the sump 112 (i.e., through the water and any waste deposited in the sump), and through a second wall 329 of the sump 112 to the receiver 322. Additionally, the ultrasonic pulse may travel along a second path from the transmitter 321, through a first wall 327 of the sump 112, through a bottom wall 328 of the sump 112, and through a second wall 329 of the sump 112 to the receiver 322.

Accordingly, for each ultrasonic pulse transmitter by the transmitter 321, the receiver 322 may receive two distinct ultrasonic pulses. The receiver 322 may receive a first ultrasonic pulse that has traveled along the first path and a second ultrasonic pulse that has traveled along the second path. The ultrasonic pulse may travel through the pedestal (e.g., vitreous material comprising the pedestal) more quickly than through the water or water and waste in the sump 112. Accordingly, the receiver 322 may receive the first and second pulses at different times. Specifically, the receiver 322 may receive the second pulse that has traveled along the second path before the receiver 322 receives the first pulse that has traveled along the second path. The second pulse that travels along the second path does not travel through the sump and thus is not indicative of the contents of the sump. Accordingly, when making a determination as to the contents of the sump 112 it may be necessary to filter out or remove the second pulse received by the receiver 322.

Referring to FIG. 11, the controller 330 includes a filtering module 331 and a selection module 332. The filtering module 331 may be configured to filter out the second pulse that has traveled through the second path from the ultrasonic pulses received (e.g., sensed, detected) by the receiver 322. Because the second pulse traveling along the second path does not flow through the sump, the time it takes for the second pulse to travel along the second path from the transmitter 321 to the receiver may constant regardless of the contents of the sump 112. Accordingly, the period of time for the second pulse to travel the second path may be calculated or measured once and then the known period of time for the second pulse to travel the second path may be used to filter or remove the second pulse from the pulses received by the receiver 322.

In some examples, the filtering module 331 may filter out the second pulse by controlling the receiver 322 so as to only receive (e.g., sense) or record (e.g., report) ultrasonic pulses received during a period of time after the second pulse has already traveled from the transmitter 321 along the second path to the receiver 322. In other examples, signal processing may be used to filter out or remove the second pulse received by the receiver 322. For example, a pulse received at or substantially at (e.g., very nearly) the known period of time for the second pulse to travel the second path after a pulse is transmitted by transmitter 321 may be subtracted or removed from the pulses identified by the receiver 322.

The selection module 332 may be configured to select a flush cycle based on the ultrasonic pulse received by the receiver 322 after the filtering by the filtering module 331. First, the selection module 332 may determine the contents of the sump 112 by comparing a time taken for the ultrasonic pulse to travel the first path to a known (e.g., calculated or measured) time required for the ultrasonic pulse to travel the first path when only water is present in the sump 112. When the measured time taken for the pulse to travel the first path exceeds (e.g., by a predetermined amount) the known time required for the pulse to travel the first path when only water is present in the sump, it may be determined that solid waste is present in the sump 112. In some examples, a magnitude of the difference between the measured time taken for the pulse to travel the first path and the known time required for the pulse to travel the first path when only water is present in the sump may be used to determine a quantity of solid waste present in the sump 112.

In some examples, the selection module 233 may estimate a quantity (e.g., volume) of solid waste using the difference between the measured time taken for the pulse to travel the first path and the known time required for the pulse to travel the first path when only water is present in the sump. In these examples, the selection module 233 may then select a flush cycle based on the estimated quantity of solid waste. In other examples, the selection module 233 may select a flush cycle based on the difference between the measured time taken for the pulse to travel the first path and the known time required for the pulse to travel the first path when only water is present in the sump.

The various flush cycles may release differing volumes of water. Accordingly, for example, when there is no difference in time or a relatively small difference in time between the measured time taken for the pulse to travel the first path and the known time required for the pulse to travel the first path when only water is present in the sump, indicative that the sump 112 does not include any solid waste, the selection module may select a flush cycle using a relatively low volume of water. Selecting a flush cycle using a relatively low volume of water, when there is no difference in time or a relatively small difference in time between the measured time taken for the pulse to travel the first path and the known time required for the pulse to travel the first path when only water is present in the sump may reduce water consumption while still evacuating the contents of the bowl. For example, a flush including a volume of water that would not be sufficient to evacuate solid waste from the bowl may be used when there is no difference in time or a relatively small difference in time between the measured time taken for the pulse to travel the first path and the known time required for the pulse to travel the first path when only water is present in the sump.

In other examples, when there is a large (e.g., relatively large, larger than a predetermined threshold) difference in time between the measured time taken for the pulse to travel the first path and the known time required for the pulse to travel the first path when only water is present in the sump, indicative of solid waste in the sump 112, the selection module 332 may select a flush cycle using a relatively large volume of water. In such a circumstance, the selection module 132 may determine that a flush cycle using a relatively large volume of water is necessary to evacuate the contents of the bowl.

The selection module 132 may use a look-up table, a series of predetermined thresholds, or the like to select a flush cycle based on the difference in time between the measured time taken for the pulse to travel the first path and the known time required for the pulse to travel the first path when only water is present in the sump. In some examples, the various flush cycles may include different ratios or percentages of the volume of water released from a rim or sump jet of the toilet. For example, when there is a relatively small difference in time between the measured time taken for the pulse to travel the first path and the known time required for the pulse to travel the first path when only water is present in the sump, indicative of only water or water and urine in the sump 112, a flush cycle in which a relatively large portion of the total volume of water used is released from the sump jet (e.g., jet solenoid 114) may be selected, as it may be determined that a relatively small amount of water is needed for bowl rinse. In other examples, when there is a relatively large difference in time between the measured time taken for the pulse to travel the first path and the known time required for the pulse to travel the first path when only water is present in the sump, indicative of solid waste in the sump 112, a flush cycle with relatively large portion of the total volume of water used being released from the rim (e.g., rim solenoid 115) may be selected. The flush cycle selected by the selection module 233 may be initiated in response to actuation of an actuator (e.g., button, lever, sensor) by a user.

In some examples, the system 300 may further include a temperature sensor (e.g., thermometer, infrared temperature sensor) configured to sense a temperature of the water in the sump 112. The velocity of the ultrasonic wave through water in the sump 112 may change as the temperature of the water changes. Accordingly, the temperature sensor may send of report a temperature of the water to the controller 330. In some example, the controller 330 may adjust a known time for a pulse to travel along the first path through the sump 112 when only water is in the sump 112, using the known temperature of the water and a known speed of sound through water at a specific temperature.

Figure 13:
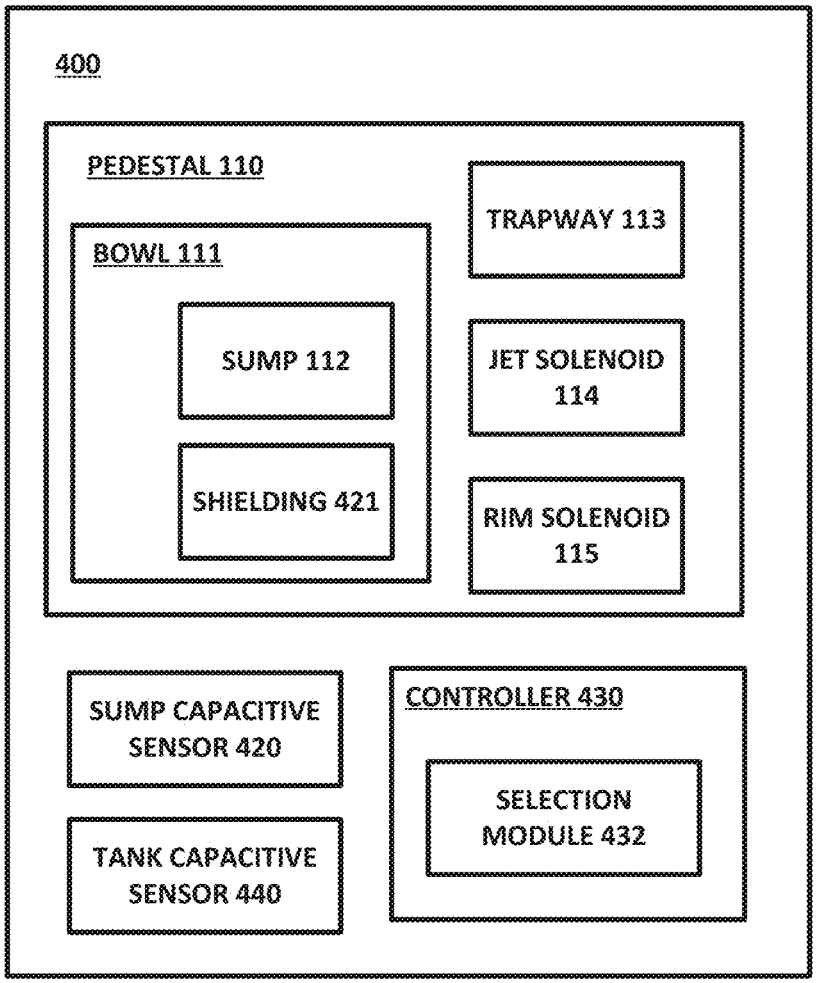
FIG. 13 illustrates a system for sensing the contents of a sump according to an exemplary embodiment of the present disclosure.

Referring to FIG. 13, a system 400 for sensing the contents of a toilet bowl and initiating a flush cycle in response to the sensed contents of the bowl is illustrated. As illustrated in FIG. 13, the system includes a pedestal 110 including a bowl 111 having a sump 112. The pedestal 110 further includes a trapway 113. In some examples, the pedestal 110 may further a jet solenoid 114 and a rim solenoid 115. The pedestal 110, bowl 111, sump 112, trapway 113, jet solenoid 114, and rim solenoid 115 may be the same as those discussed above with respect to FIG. 3.

Figure 14:
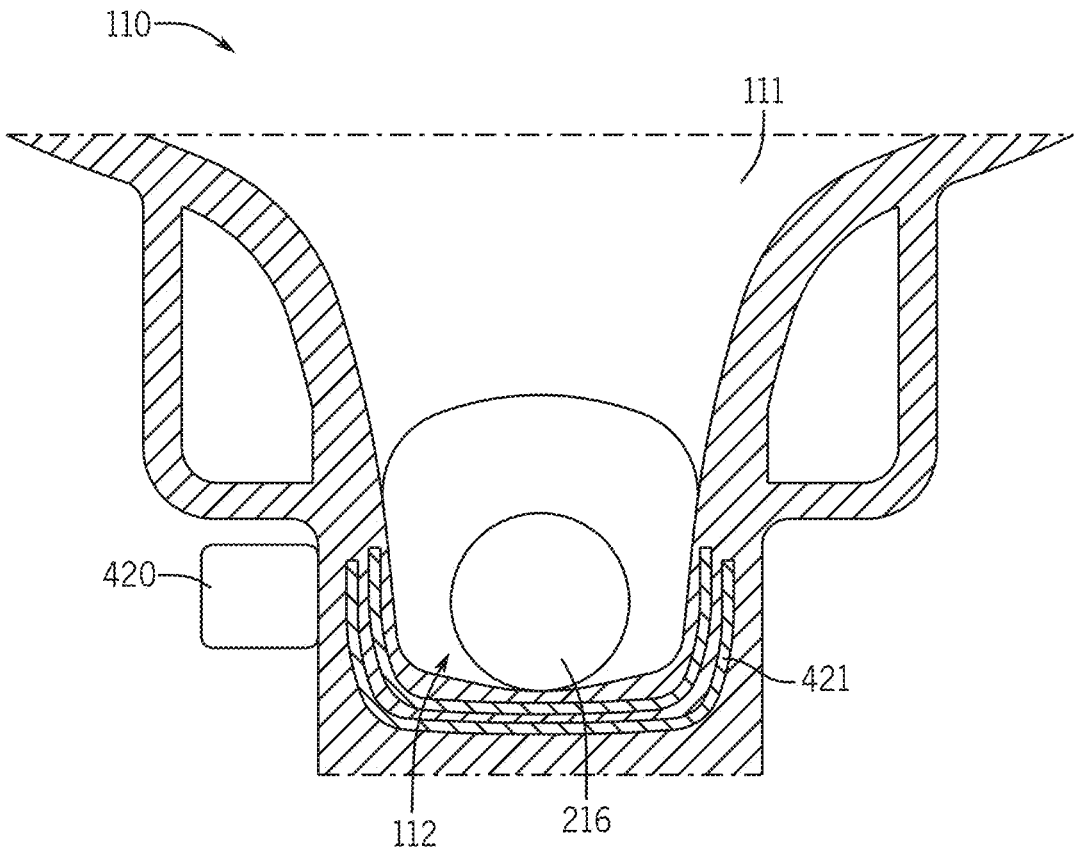
FIG. 14 illustrates a partial cross-section view of a toilet according to an exemplary embodiment of the present disclosure.

The system 400 further include a capacitive sensor 420 (e.g., sump capacitive sensor) connected (e.g., electrically) to a controller 430. Referring to FIG. 14, the capacitive sensor 420 may be disposed adjacent to the sump 112. For example, as illustrated in FIG. 14, the capacitive sensor 420 may be attached or coupled to an exterior surface of the pedestal 110 adjacent to the sump 112. The capacitive sensor 420 may include an electrode configured to create an electric field in the sump 112. The capacitive sensor 420 may be configured to sense (e.g., detect, determine) the dielectric constant of the contents of the sump 112. For example, when only water is present in the sump 112, the capacitive sensor 420 may sense or output the dielectric constant of the contents of the sump 112 as the dielectric constant of water.

The capacitive sensor 420 may continuously sense and/or output the dielectric constant of the contents of the sump 112. Accordingly, when there is a change in the dielectric constant sensed (e.g., from that of water), it may be determined that waste (e.g., urine, toilet paper, solid fecal matter) has been deposited into the sump 112.

In some examples, the system 400 may further include shielding 421. The shielding 421 may be comprised of a conductive material and connected to analog ground. The shielding 421 may be configured to direct the sensitivity of the capacitive sensor 420 upward toward the sump 112. For example, the shielding 421 may be configured to prevent or limit the detection of materials and/or electronic components outside of the sump 112 of the toilet. In some examples, as illustrated in FIG. 14, the shielding 421 may be provided along a bottom surface and/or side surfaces of the sump 112.

In some examples, the system 400 may further include a second capacitive sensor 440 (e.g., tank capacitive sensor 440). The second capacitive sensor 440 may be located for example at or near the tank (e.g., tank 11) of the toilet. For examples, the second capacitive sensor 440 may be coupled to a wall (e.g., 26) of the tank, a fill valve (e.g., fill valve float), or a flush valve disposed in the tank (e.g., 11). The second capacitive sensor 440 may be configured to sense or determine the dielectric constant of the tank. Because it is known that only water is present in the tank of the toilet, the dielectric constant measured by the second capacitive sensor may be used as a reference or baseline. For example, a dielectric constant sensed inside of the tank may be compared to the dielectric constant in the sump 112 measured by the capacitive sensor 420. When the dielectric constant measured in the tank differs from the dielectric constant measured in the sump 112, it may be determined that the contents of the sump 112 include something other than water (e.g., waste).

In some examples, when sensing the contents of the sump 112, specifically when distinguishing between the presence of water alone or water and urine in the sump, the baseline dielectric constant measured in the tank may be comparted to the dielectric constant measured in the sump 112 to identify a (relatively) small difference in dielectric constant caused by the presence of a higher concentration of electrolytes present in urine as compared to water.

In some examples, the magnitude in the difference in the dielectric constant sensed by the capacitive sensor 420 compared to the known dielectric constant of water or the reference dielectric constant of water sensed in the tank may correspond to a quantity of waste (i.e., contents other than water) present in the sump. For example, the larger the difference between the dielectric constant sensed by the capacitive sensor 420 compared to the known dielectric constant of water or the reference dielectric constant of water sensed in the tank the more waste present in the sump 112.

In some examples, when there is no difference in the magnitude of the dielectric constant in the sump 112 sensed by the capacitive sensor 420 and the known dielectric constant of water or the reference dielectric constant of water sensed in the tank or the magnitude of the difference is relatively small, it may be determined that there is no solid waste present in the sump 112. In other examples, when the difference in the magnitude of the dielectric constant in the sump 112 sensed by the capacitive sensor 420 and the known dielectric constant of water or the reference dielectric constant of water sensed in the tank or the magnitude of the difference is relatively large, it may be determined that the contents of the sump include solid waste (e.g., toilet paper, solid fecal matter).

Referring to FIG. 13, the controller 430 includes a selection module 332. The selection module may receive the sensed dielectric constants (e.g., in the sump 112 and the tank) from the capacitive sensor 420 and the second capacitive sensor 440. The selection module 332 may be configured to select a flush cycle based on the sensed dielectric constants. Specifically, the selection module 432 may be configured to select a flush cycle based on a difference between the dielectric constant sensed by the capacitive sensor 420 compared to the known dielectric constant of water or the reference dielectric constant of water sensed in the tank. A look up table and/or one or more thresholds may be set and used to determine a volume of water to be dispensed during a flush cycle based on a magnitude of the difference between the dielectric constants.

The various flush cycles may release differing volumes of water. Accordingly, for example, when there is a small (e.g., relatively small) difference between the dielectric constant sensed by the capacitive sensor 420 compared to the known dielectric constant of water or the reference dielectric constant of water sensed in the tank, indicative of the presence of only water or water and urine in the sump, the selection module 432 may select a flush cycle using a relatively low volume of water. Conversely, when there is a large (e.g., relatively large) difference between the dielectric constant sensed by the capacitive sensor 420 compared to the known dielectric constant of water or the reference dielectric constant of water sensed in the tank, indicative of the presence of solid waste in the sump 112, the selection module 432 may select a flush cycle using a relatively large volume of water. In such a circumstance, the selection module 432 may determine that a flush cycle using a relatively large volume of water is necessary to evacuate the contents of the bowl.

The selection module 432 may use a look-up table, a series of predetermined thresholds, or the like to select a flush cycle based on the difference between the dielectric constant sensed by the capacitive sensor 420 compared to the known dielectric constant of water or the reference dielectric constant of water sensed in the tank. In some examples, the various flush cycles may include different ratios or percentages of the volume of water released from a rim or sump jet of the toilet. The flush cycle selected by the selection module 132 may be initiated in response to actuation of an actuator (e.g., button, lever, sensor) by a user.

Referring generally to the systems 100, 200, 300, and 400 of FIGS. 3, 8, 11, and 13, respectively, each of the identified sensors (i.e., first photogate 120, second photogate 140, third photogate 160, fourth photogate 170, camera 210, transmitter 321, receiver 322, and capacitive sensor 420) and the respective controller (i.e., 130, 230, 330, 430) described with reference to the identified sensor may be referred to herein as a flush selection unit.

Figure 15:
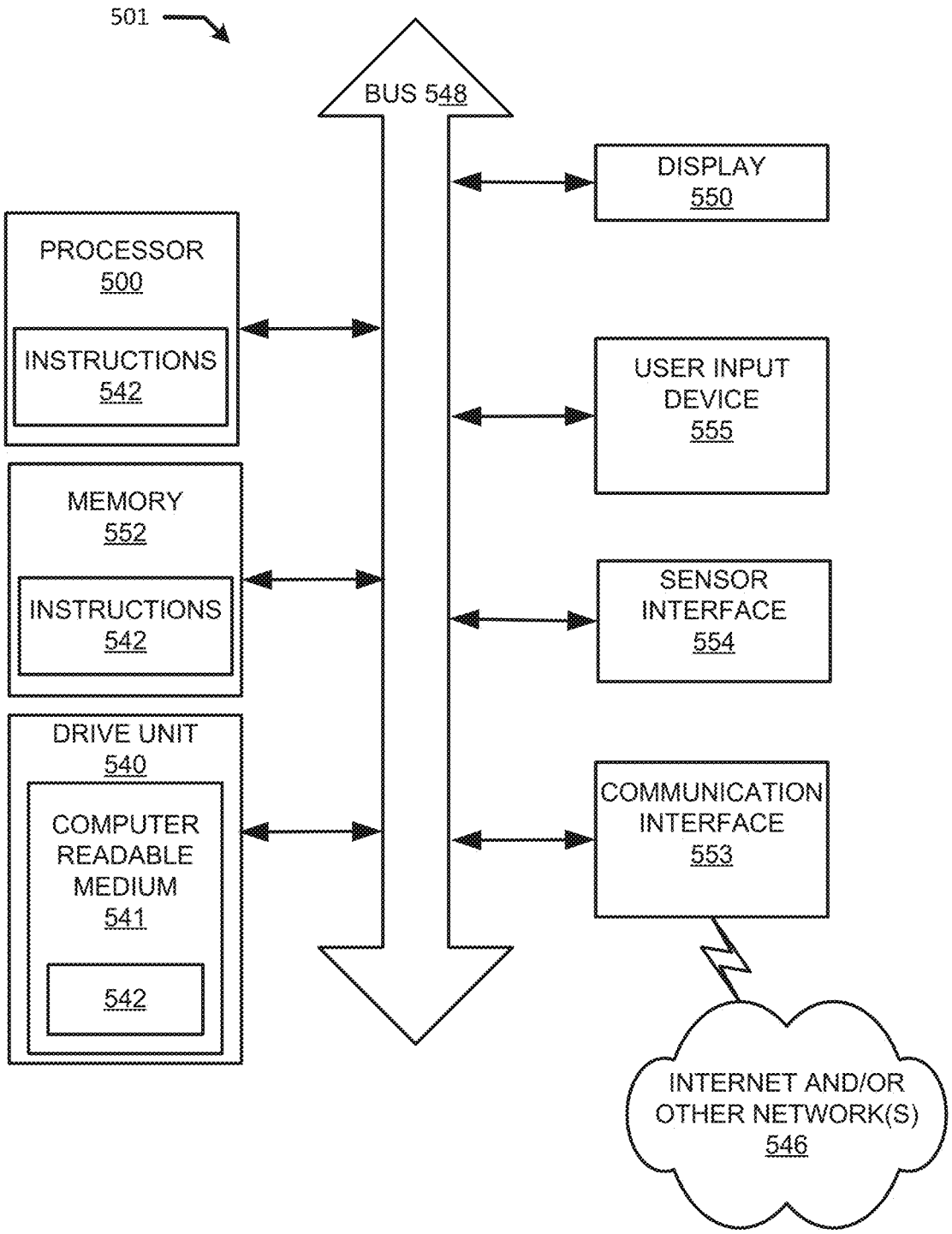
FIG. 15 illustrates a controller according to an exemplary embodiment of the present disclosure.

Referring to FIG. 15, a controller 501 according to an example of the present disclosure is illustrated. Any of the controllers 130, 230, 330, and/or 430 described herein may include one or more components of the controller 501 described hereinbelow. Similarly, the controller 501 may be configured to perform any one or more of the functionalities of the systems 100, 200, 300, 400 described herein. The controller 501 may include a processor 500, a memory 552, and a communication interface 553 for interfacing with devices or to the internet and/or other networks 546. In addition to the communication interface 553, a sensor interface 554 may be configured to receive data from one or more sensors (e.g., first photogate 120, second photogate 140, third photogate 160, fourth photogate 170, camera 210, transmitter 321 and receiver 322, capacitive sensor 420). The components of the control system may communicate using bus 548. The control system (e.g., controller 501) may be connected to a workstation or another external device (e.g., control panel) and/or a database for receiving user inputs.

Optionally, the controller 501 may include an input device 555. The input device 555 may include an actuator for initiating a flush cycle selected by any of the selection modules 132, 233, 332, and/or 432 described herein. The input device 555 may include a lever, a button, a switch, and/or a touchscreen coupled to or integrated with the toilet, a keyboard, a microphone for voice inputs, a camera for gesture inputs, and/or another mechanism.

Optionally, the control system may include a drive unit 540 for receiving and reading non-transitory computer media 541 having instructions 542. Additional, different, or fewer components may be included. The processor 500 is configured to perform instructions 542 stored in memory 552 for executing the algorithms described herein. A display 550 may be supported by the toilet. The display may be combined with the user input device 555.

The controller 501 may receive sensor data indicative of usage of the toilet and/or contents of the sump 112 from one or more sensors (e.g., first photogate 120, second photogate 140, third photogate 160, fourth photogate 170, camera 210, transmitter 321 and receiver 322, capacitive sensor 420) through the sensor interface 554.

The sensor interface 554 may be in communication any type of sensor configured to detect certain actions and/or to provide functionality (e.g., dispensing, flushing, etc.) disposed within or proximate to the toilet. For example, the sensor interface 554 may be in communication with a proximity sensor to initiate a flush cycle.

The sensor may include any type of sensor configured to detect certain conditions and/or to provide functionality. Odor sensors, proximity sensors, and motion sensors are non-limiting examples of sensors that may be employed with the systems of this application. Odor sensors, such as volatile organic compound (VOC) sensors, may be employed to detect organic chemicals and compounds, both human made and naturally occurring chemicals/compounds. Proximity sensors may be employed to detect the presence of an object within a zone of detection without physical contact between the object and the sensor. Electric potential sensors, capacitance sensors, projected capacitance sensors, and infrared sensors (e.g., projected infrared sensors, passive infrared sensors) are non-limiting examples of proximity sensors that may be employed with the systems of this application. Motion sensors may be employed to detect motion (e.g., a change in position of an object relative to the objects surroundings). Electric potential sensors, optic sensors, radio-frequency (RF) sensors, sound sensors, magnetic sensors (e.g., magnetometers), vibration sensors, and infrared sensors (e.g., projected infrared sensors, passive infrared sensors) are non-limiting examples of motion sensors that may be employed with the systems of this application.

In another example, the sensor may include a light detection and ranging (LIDAR) that servers as a proximity sensor. The controller 501 receives sensor data such as a point cloud, from the sensor and analyzes the sensor data to determine when a user is approaching or has approached the toilet.

The processor 500 may be a general purpose or specific purpose processor, an application specific integrated circuit (ASIC), one or more programmable logic controllers (PLCs), one or more field programmable gate arrays (FPGAs), a group of processing components, or other suitable processing components. Processor 500 is configured to execute computer code or instructions stored in memory 552 or received from other computer readable media (e.g., embedded flash memory, local hard disk storage, local ROM, network storage, a remote server, etc.). The processor 500 may be a single device or combinations of devices, such as associated with a network, distributed processing, or cloud computing.

The memory 552 may include one or more devices (e.g., memory units, memory devices, storage devices, etc.) for storing data and/or computer code for completing and/or facilitating the various processes described in the present disclosure. Memory 552 may include random access memory (RAM), read-only memory (ROM), hard drive storage, temporary storage, non-volatile memory, flash memory, optical memory, or any other suitable memory for storing software objects and/or computer instructions. Memory 552 may include database components, object code components, script components, or any other type of information structure for supporting the various activities and information structures described in the present disclosure. Memory 552 may be communicably connected to processor 500 via a processing circuit and may include computer code for executing (e.g., by processor 500) one or more processes described herein. For example, memory 552 may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface 553 may include any operable connection. An operable connection may be one in which signals, physical communications, and/or logical communications may be sent and/or received. An operable connection may include a physical interface, an electrical interface, and/or a data interface. The communication interface 553 may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory 552) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The controller 501 may be configured to select a flush cycle in response to the sensor (e.g., first photogate 120, second photogate 140, third photogate 160, fourth photogate 170, camera 210, transmitter 321 and receiver 322, capacitive sensor 420) data received.

Figure 16:
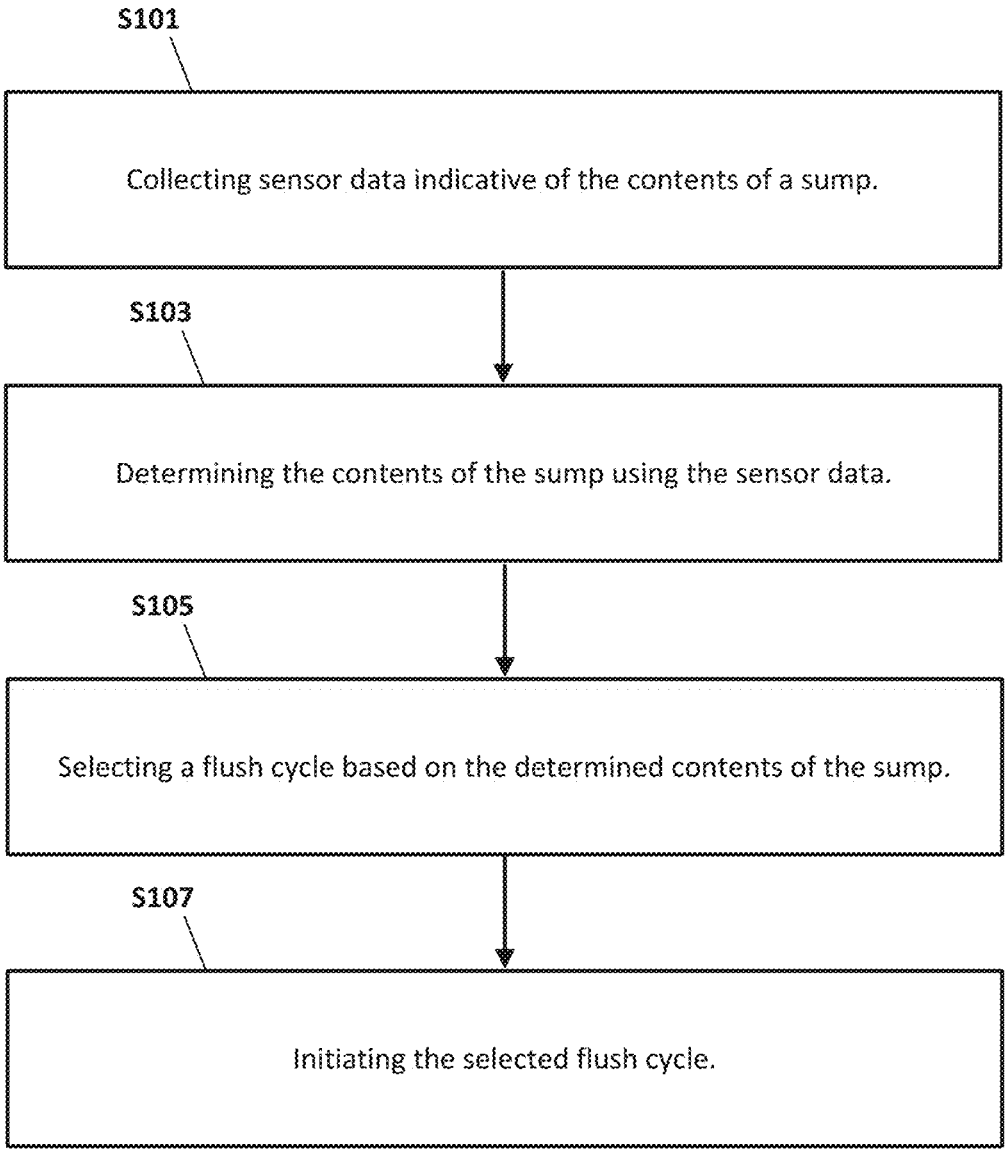
FIG. 16 is a flow chart for the embodiments of FIG. 1-15.

Referring to FIG. 16, a flow chart for selecting a flush cycle according to one example of the present disclosure is illustrated. The flow chart of FIG. 16 may be used with any of the systems 100, 200, 300, 400 described herein. Additional, different, or fewer acts may be provided.

In a first act S101, the contents of the sump or bowl of a toilet may be sensed. Any of the sensors included in the systems 100, 200, 300, and 400 may be used to sense the contents of the sump. Specifically, any of the first photogate 120, camera 210, ultrasonic transmitter 321 and receiver 322, and the capacitive sensor 420 may be used to sense the contents of the sump. In some examples, any of the sensors described herein may continuously sense the contents of the bowl. In other examples, any of the sensors described herein may intermittently sense the contents of the bowl, for example after a predetermined period of time. In some examples, one or more additional sensors, e.g., a proximity sensor, may be configured to detect the presence of a user in the vicinity of the toilet and the sensors may begin sensing the contents of the sump when a user is near the toilet. In yet other examples, the flow chart of FIG. 16, including sensing the contents of the sump after a user operates an actuator for flushing the toilet.

The sensor (e.g., 120, 210, 321 and 322, 420) used to sense the contents of the sump may be connected to and/or in communication with a respective controller (e.g., 130, 230, 330, 430). Each of the sensors may be configured to send the sensed sensor data indicative of the contents of the sump to a respective controller and the respective controller may be configured to receive the sensor data from the sensor.

In a second act S103, the contents of the sump may be determined using the sensor data. For example, the controllers 130, 230, 330, and 430 may determine whether there is just water, urine, toilet paper, and/or solid fecal matter present in the sump. Specifically, each of the controllers 130, 230, 330 and 430 may be configured to determine the contents of the sump using the sensor data from their respective sensor 120, 210, 321 and 322, and 420. For example, the controller 130 may determine the contents of the sump using sensor data indicative of an attenuation in light intensity. In another example, the controller 230 may determine the contents of the sump using sensor data including images of the sump. In yet another example, the controller 330 may determine the contents of the sump using sensor data indicative of a length of time taken for an ultrasonic pulse to pass to travel through the sump. In still another example, the controller 430 may determine the contents of the sump using sensor data indicative of a dielectric constant of the contents of the sump.

Any of the controllers 130, 230, 330, 430 may determine the contents of the sump by comparing the sensor data to one or more known or measured quantities. In some examples, the sensor data may be compared to one or more reference or look-up tables to determine the contents of the sump.

In a third act S105, a flush cycle is selected using the determined contents of the sump. Specifically, after any of the controllers 130, 230, 330, 430 determine the contents of the sump, the controller may further be configured to select a flush cycle based on or using the determined contents of the sump. Accordingly, the respective controller may select a flush cycle that uses a volume of water corresponding to the contents of the sump. For example, the controller may select a low-volume flush cycle when it is determined that no solid waste is present in the sump and a high-volume flush cycle when it is determined that there is solid waste present in the sump. Accordingly, a flush cycle may be tailored with respect to the determined contents of the sump to reduce or prevent an excess volume of water not necessary to evacuate the contents of the bowl from being used.

In a fourth act S107, the selected flush cycle may be initiated. In some examples, the flush cycle may be initiated in response to activation of an actuator (e.g., button, lever, sensor) by a user. In other examples, a sensor may be configured to detect the presence of a user proximate to the toilet and may initiation a flush cycle, for example, after a user has been detected in a vicinity or proximity of the toilet and the sensor has subsequently determined that a user is no longer in the vicinity of the toilet.

In some examples, the flow chart of FIG. 15 may further include determining if the contents of the sump have been evacuated from the toilet. For example, a photogate (e.g., second photogate 140) may be disposed in the trapway, for example, the second portion 118 of the trapway extending downwardly from a weir to an exiting device of the toilet. The photogate may be configured to sense or detect the contents flowing through the trapway and/or contents disposed between the photogate. Accordingly, the contents sensed by the photogate can be compared to the determined contents of the bowl to determine whether the contents of the bowl have traveled past the photogate and thus out of the toilet.

In some examples, the determining the contents of the sump may further include filtering out or removing a portion of the sensor data to determine the contents of the sump. For example, a controller (e.g., controller 330) may include a filtering module (e.g., filtering module 331). The filtering module may be configured to filter out or remove an ultrasonic pulse that has traveled from a transmitter (e.g., transmitter 321), through a first wall 327 of the sump 112, through a bottom wall 328 of the sump 112, and through a second wall 329 of the sump 112 to a receiver (e.g., receiver 322). A period of time for such a pulse to travel from the transmitter to the receiver may be known or measured. Accordingly, the known or measured period of time may be used to identify and remove the pulse from the sensor data.

In some examples, the determining the contents of the sump may further include performing video processing, for example by a video processing module 231, on the sensed images of the sump. In some examples, the determining the contents of the sump may further included calculating an area of waste, for example by a calculation module 232.

In some examples, the determining the contents of the sump may further include comparing a sensed dielectric constant in the sump to a sensed dielectric constant in a tank of the toilet to determine the contents of the sump.

When a component, device, element, or the like of the present disclosure is described as having a purpose or performing an operation, function, or the like, the component, device, or element should be considered herein as being "configured to" meet that purpose or to perform that operation or function.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A toilet comprising:

a bowl including a sump;

a trapway in fluid communication with the sump;

a first photogate coupled to the sump and configured to detect a presence of waste in the sump;

a second photogate coupled to the trapway and configured to detect a presence of waste in the trapway; and a controller configured to monitor the second photogate during a flush cycle to determine whether waste is present between the second photogate in response to a determination that waste is present between the first photogate.

2. The toilet of claim 1, wherein the trapway includes a weir, a first portion extending upwardly from the sump to the weir, and a second portion extending downwardly from the weir, and wherein the second photogate is coupled to the second portion of the trapway.

3. The toilet of claim 2, further comprising:

a third photogate coupled to the trapway, the third photogate including a third emitter configured to emit a third light into the trapway and a third detector configured to detect an intensity of the third light.

4. The toilet of claim 3, wherein the third photogate is coupled to the first portion of the trapway.

5. The toilet of claim 1, wherein the first photogate includes a first emitter configured to emit a first light into the sump and a first detector configured to detect an intensity of the first light, and wherein the second photogate includes a second emitter configured to emit a second light into the trapway and a second detector configured to detect an intensity of the second light.

6. The toilet of claim 5, wherein the first emitter and the first detector are disposed on opposite sides of the sump, and wherein the second emitter and second detector are disposed on opposite sides of the trapway.

7. The toilet of claim 5, wherein the first detector is configured to detect an attenuation of the first light emitted by the first emitter, and wherein the controller is configured to determine a type of waste disposed in the sump based on the attenuation of the first light.

8. The toilet of claim 7, wherein the second detector is configured to detect an attenuation of the second light emitted by the second emitter, and wherein the controller is configured to determine a type of waste disposed in the trapway based on the attenuation of the second light.

9. The toilet of claim 1, wherein based on a determination by the controller that waste is not present between the second photogate during the flush cycle, the controller initiates a subsequent flush cycle.

10. The toilet of claim 1, wherein the first photogate includes a first emitter configured to emit a first light into the sump and a first detector configured to detect an intensity of the first light, wherein the second photogate includes a second emitter configured to emit a second light into the trapway and a second detector configured to detect an intensity of the second light, wherein the controller is configured to compare an attenuation of the first light and an attenuation of the second light to determine whether waste detected between the first photogate has traveled through the second photogate.

* * * * *